US007578388B2

(12) United States Patent
O'Connell et al.

(10) Patent No.: US 7,578,388 B2
(45) Date of Patent: Aug. 25, 2009

(54) RETAIL DISPLAY FOR PUMP DISPENSER FOR USE WITH SUBSTRATES

(75) Inventors: Tami O'Connell, Pleasanton, CA (US); Laura Itzkowitz, Oakland, CA (US); Ricardo Ruiz de Gopegui, Dublin, CA (US); Jodi Lynn Russell, Castro Valley, CA (US); Peddy Khatami, Pleasant Hill, CA (US); Agnete Enga, Brooklyn, NY (US); John Kiechel, San Francisco, CA (US); Nasahn Sheppard, Mill Valley, CA (US)

(73) Assignee: The Clorox Company, Oakland, CA (US)

( * ) Notice: Subject to any disclaimer, the term of this patent is extended or adjusted under 35 U.S.C. 154(b) by 223 days.

(21) Appl. No.: 11/741,361

(22) Filed: Apr. 27, 2007

(65) Prior Publication Data

US 2008/0264827 A1 Oct. 30, 2008

(51) Int. Cl.
*B65D 69/00* (2006.01)

(52) U.S. Cl. ..... 206/229; 206/223; 53/447; 222/205

(58) Field of Classification Search ..... 206/223, 206/229, 230, 459.5, 497, 581; 215/228, 215/230; 220/212, 694; 222/109, 190, 205, 222/321.9, 330, 372, 378, 1; 132/293, 294, 132/298; 401/188 R, 262–266, 195
See application file for complete search history.

(56) References Cited

U.S. PATENT DOCUMENTS 3,263,871 A * 8/1966 Thompson ..... 222/205
4,306,653 A * 12/1981 Fales ..... 206/497
4,550,914 A 11/1985 McCallister
4,948,078 A 8/1990 Dumenigo
4,983,061 A 1/1991 Demarest
5,362,561 A * 11/1994 Lower ..... 215/386
5,397,297 A * 3/1995 Hunter ..... 206/440
5,626,094 A 5/1997 Jeffery et al.
5,865,013 A 2/1999 Jackson
6,189,690 B1 2/2001 Izen et al.
6,318,555 B1 11/2001 Kuske et al.
6,345,716 B1 2/2002 Chapman (Continued)

OTHER PUBLICATIONS http://www.saint-gobain-calmar.com/products.aspx?c=prod&sc=2&pid=20 (Calmar MD3200)—Oct. 19, 2006, 3 pages.

*Primary Examiner*—Luan K Bui
(74) *Attorney, Agent, or Firm*—David Peterson

(57) ABSTRACT

A retail or advertising display contains visual cues which convey the area of use and the method of use of a novel vertical pump-up dispenser to the consumer. Having a sponge or other substrate on top of the dispenser conveys the area of use of the dispenser. The dispenser has a large actuator surface designed to convey that it can deliver a composition to a broad substrate area, such as a sponge, in the consumer's hand without the consumer having to pick up the pump dispenser. Having a hand over the substrate and dispenser conveys the one-handed method of cleaning that the dispenser allows. There may be additional indicia of use, such as arrows pointing down. The retail display may contain the dispenser and the substrate packaged together.

7 Claims, 24 Drawing Sheets

U.S. PATENT DOCUMENTS 6,386,776 B2 * 5/2002 Scariano ..... 206/581
6,431,405 B2 8/2002 Irwin
6,612,846 B1 9/2003 Underhill et al.
6,648,864 B2 11/2003 Ronn et al.
6,757,002 B1 6/2004 Oross et al.
6,805,926 B2 10/2004 Cote et al.
7,004,659 B1 * 2/2006 Goodman ..... 401/188 R
7,024,810 B2 4/2006 Kim
2001/0054564 A1 * 12/2001 Bethune et al. ..... 206/459.5
2003/0088224 A1 5/2003 Ceman et al.
2005/0039293 A1 2/2005 McReynolds et al.
2005/0087475 A1 * 4/2005 Byun ..... 206/581
2005/0109363 A1 * 5/2005 Matsuoka ..... 132/298
2005/0148979 A1 7/2005 Palma et al.
2006/0135936 A1 6/2006 Markovich

* cited by examiner

RETAIL DISPLAY FOR PUMP DISPENSER FOR USE WITH SUBSTRATES

BACKGROUND OF THE INVENTION

1. Field of the Invention

This invention relates to advertising and retail displays for pump dispensers for use with substrates such as paper towels, wipes, woven or nonwoven dishcloth, and sponges, and displays illustrating a method for using these pump dispensers to communicate to the consumer.

2. Description of the Related Art

Consumers have traditionally applied cleaning and disinfecting compositions by spraying on a surface and wiping with a paper towel or by adding a cleaner to a sponge, activating with water, wiping with the sponge, and rinsing the sponge. Although this procedure is inefficient because the consumer must go through several cleaning steps, consumers are accustomed to using these products and no special training is required to communicate how these products must be used.

There exist several retail packaging combinations that help convey product information for very familiar products. U.S. Pat. No. 6,612,846 to Underhill et al. discloses a method of displaying toilet training materials in an in-store kiosk. U.S. Pat. No. 6,648,864 to Ronn et al. discloses a sequence of designs of diapers that facilitates the consumer's selection of an appropriate absorbent article. U.S. Pat. No. 6,189,690 to Izen et al. discloses retail packaging for a musical instrument to facilitate trial of the instrument by the consumer. U.S. Pat. No. 6,345,716 to Chapman discloses a retail display that combines a mannequin face in a swimmer's mask that displays how the mask would be worn. U.S. Pat. No. 5,865,013 to Jackson discloses a package combination of a hat and garment. It may be even more important to convey such product information for unfamiliar products.

U.S. Pat. App. 2005/0009940 to Goldstein et al. discloses a method of promoting the sale of a melamine foam substrate by associating the substrate with a brand name or logo of a hard surface cleaner. The brand name is important because consumers are reluctant to try new cleaning means if the cleaning means differs from the currently known cleaning means. U.S. Pat. No. 6,431,405 to Irwin describes a fluid dispenser and a pop-up sheet dispenser providing convenience to the consumer while making it obvious for shoppers to quickly understand how to use the combined dispensing system.

Consumers are looking for cleaning means the will both save steps and can be used with one hand in an on-the-go manner. Current liquid dispensers are not adequate for one hand application of cleaning and disinfecting compositions to cleaning substrates such as paper towels. Dispensers such as trigger sprayers or pump dispensers generally require one hand to hold and activate the dispenser and one hand to hold the cleaning substrates. Existing vertical pump-up dispensers that can be ergonomically operated with the same hand that holds the cleaning substrate have small actuators that require the hand and substrate to be contracted into a ball in order to activate the dispenser. Wet disinfectant or cleaning wipes, such as described in U.S. Pat. No. 6,716,805 to Sherry et al., are becoming increasingly popular for their convenience in combining a nonwoven, disposable substrate with a disinfecting or cleaning solution. Soap-loaded disposable dish cloths, as described in U.S. Pat. No. 6,652,869 to Suazon et al., are also popular for their convenience. These products combine the cleaning solution and the cleaning substrate in one system so that the consumer can perform the cleaning task with one hand and with one product. However, these systems have some drawbacks such as requiring water activation of a dry substrate or requiring a sealed packaging for a wet substrate.

The pump dispenser of the present invention is designed to overcome the inefficiencies of current consumer behavior. However, because the consumer is using the pump dispenser in a different, more convenient one-handed fashion, certain advertising and retail displays may be needed to teach the consumer how to use the product. We have found that packaging or advertising showing the substrate, such as a sponge sitting on top of the dispenser, along with a hand above the substrate, may be necessary for consumers to understand how to use this dispenser. Additionally, indicia showing that the consumer should press down on the substrate and the device may be required.

To overcome these problems of cleaning systems and cleaning products and to educate the consumer on the use of this new system, the advertising and retail displays of the present invention are designed to allow the consumer to understand how to use these product without having to read detailed instructions.

SUMMARY OF THE INVENTION

In accordance with the above objects and those that will be mentioned and will become apparent below, one aspect of the present invention comprises an advertising display comprising a first product comprising a container having an actuator and a fluid distribution system, wherein the fluid distribution system comprises a tube delivering fluid to the actuator top surface, wherein depression of the actuator causes fluid to travel through the tube toward the actuator top surface, and wherein a subsystem of the fluid distribution system delivers fluid to an area of the actuator top surface greater than the circumferential area of the tube; a second product positioned above the first product and comprising a substrate; and a consumer hand above the second product.

In accordance with the above objects and those that will be mentioned and will become apparent below, another aspect of the present invention comprises retail display for a set of products comprising a first product comprising a container having an actuator and a fluid distribution system, wherein the fluid distribution system comprises a tube delivering fluid to the actuator top surface, and wherein depression of the actuator causes fluid to travel through the tube toward the actuator top surface, wherein a subsystem of the fluid distribution system delivers fluid to an area of the actuator top surface greater than the circumferential area of the tube; a second product comprising a substrate; and packaging for the set of products; wherein the actuator top is concave; wherein the second product sits on top of the actuator top surface and is held in place by the packaging as part of the retail display.

In accordance with the above objects and those that will be mentioned and will become apparent below, another aspect of the present invention comprises a retail display for a set of products comprising a first product comprising a container having an actuator and a fluid distribution system, wherein the fluid distribution system comprises a tube delivering fluid to a surface distribution channel formed in an actuator top surface, wherein depression of the actuator causes fluid to travel through the tube toward the surface distribution channel, wherein an area of the actuator top surface covered by the surface distribution channel is greater than a circumferential area of the tube; a second product comprising a substrate; and packaging for the set of products; wherein the second product sits on top of the actuator top surface and is held in place by the packaging as part of the retail display.

BRIEF DESCRIPTION OF THE DRAWINGS

In the accompanying drawings that form part of the specification, and in which like numerals are employed to designate like parts throughout the same.

DETAILED DESCRIPTION OF THE INVENTION

Figure 1:
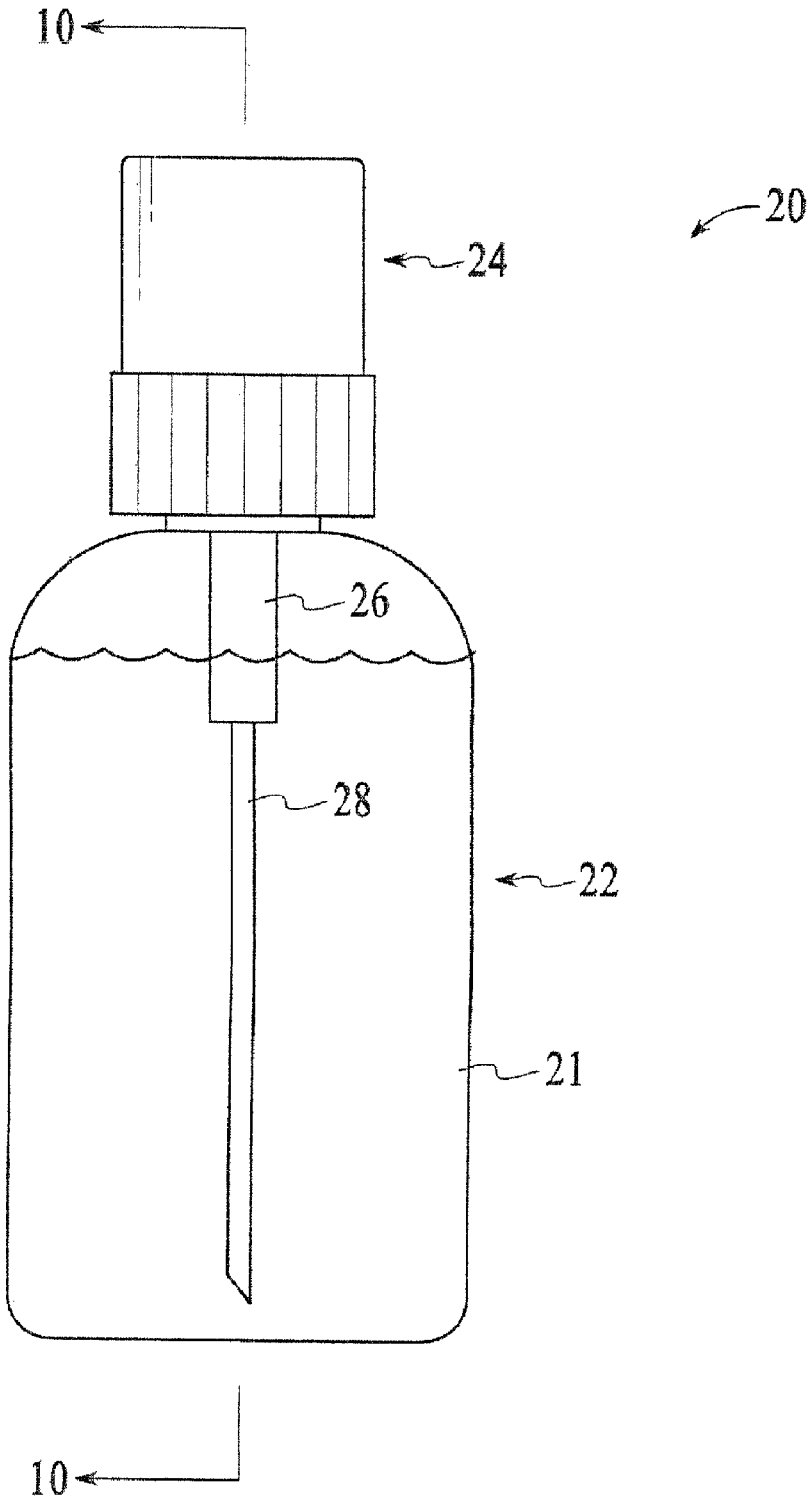
FIG. 1 is a front view of a first embodiment of a pump dispensing package of the present invention, and the package is shown assembled in a condition prior to use.

While this invention is susceptible of embodiment in many different forms, this specification and the accompanying drawings disclose only some specific forms as examples of the invention. The invention is not intended to be limited to the embodiments so described. It is also to be understood that the terminology used herein is for the purpose of describing particular embodiments of the invention only, and is not intended to limit the scope of the invention in any manner. The scope of the invention is pointed out in the appended claims.

For ease of description, the components of this invention and the container employed with the components of this invention are described in the normal (upright) operating position, and terms such as upper, lower, horizontal, etc., are used with reference to this position. It will be understood, however, that the components embodying this invention may be manufactured, stored, transported, used, and sold in an orientation other than the position described.

Figures illustrating the components of this invention and the container show some conventional mechanical elements that are known and that will be recognized by one skilled in the art. The detailed descriptions of such elements are not necessary to an understanding of the invention, and accordingly, are herein presented only to the degree necessary to facilitate an understanding of the novel features of the present invention.

All publications, patents and patent applications cited herein, whether supra or infra, are hereby incorporated by reference in their entirety to the same extent as if each individual publication, patent or patent application was specifically and individually indicated to be incorporated by reference.

As used herein and in the claims, the term "comprising" is inclusive or open-ended and does not exclude additional unrecited elements, compositional components, or method steps. Accordingly, the term "comprising" encompasses the more restrictive terms "consisting essentially of" and "consisting of".

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

In the application, effective amounts are generally those amounts listed as the ranges or levels of ingredients in the descriptions, which follow hereto. All percentages, ratios and proportions are by weight, and all temperatures are in degrees Celsius (° C.), unless otherwise specified. All measurements are in SI units, unless otherwise specified. Unless otherwise stated, amounts listed in percentage ("%'s") are in weight percent (based on 100% active) of the cleaning composition alone. It should be understood that every limit given throughout this specification will include every lower, or higher limit, as the case may be, as if such lower or higher limit was expressly written herein. Every range given throughout this specification will include every narrower range that falls within such broader range, as if such narrower ranges were all expressly written herein.

The term "surfactant", as used herein, is meant to mean and include a substance or compound that reduces surface tension when dissolved in water or water solutions, or that reduces interfacial tension between two liquids, or between a liquid and a solid. The term "surfactant" thus includes anionic, nonionic, cationic and/or amphoteric agents.

The composition can be used as a disinfectant, sanitizer, and/or sterilizer. As used herein, the term "disinfect" shall mean the elimination of many or all pathogenic microorganisms on surfaces with the exception of bacterial endospores. As used herein, the term "sanitize" shall mean the reduction of contaminants in the inanimate environment to levels considered safe according to public health ordinance, or that reduces the bacterial population by significant numbers where public health requirements have not been established. An at least 99% reduction in bacterial population within a 24 hour time period is deemed "significant." As used herein, the term "sterilize" shall mean the complete elimination or destruction of all forms of microbial life and which is authorized under the applicable regulatory laws to make legal claims as a "Sterilant" or to have sterilizing properties or qualities.

As used herein, the term "polymer" generally includes, but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

The term "plastic" is defined herein as any polymeric material that is capable of being shaped or molded, with or without the application of heat. Usually plastics are a homo-polymer or co-polymer that of high molecular weight. Plastics fitting this definition include, but are not limited to, polyolefins, polyesters, nylon, vinyl, acrylic, polycarbonates, polystyrene, and polyurethane.

Advertising and Retail Displays

Figure 7A:
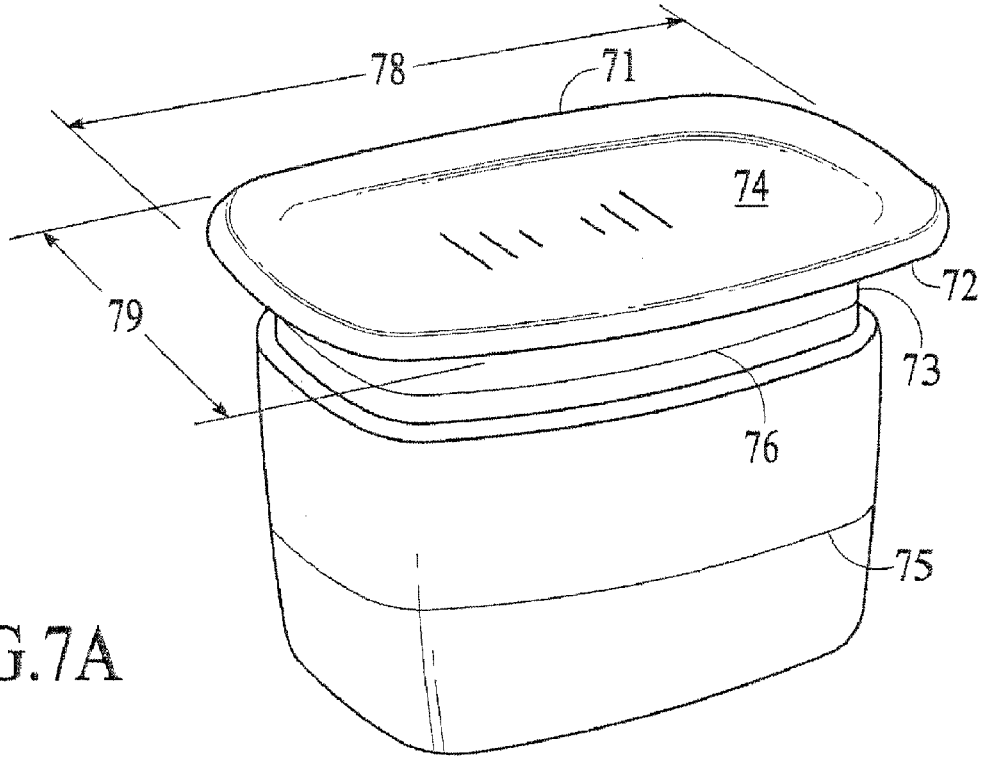
FIG. 7A is a perspective view of an embodiment of a pump dispensing package of the present invention, and the package is shown assembled in a condition prior to use.

Vertical pump-up dispensers, such as shown in FIG. 7A, are novel to the consumer and while they are easy and convenient to use, they are not intuitive because they have a novel appearance and they allow a change in consumer behavior, a one-handed loading and cleaning with a substrate. Consumers, when walking down the store isle and choosing a new product for the first time, must instantly grasp the use and value of that new product. Consumers do not generally bother to read a set of instructions before choosing a new product and depend upon visual cues to educate them. Because of this, new products which change consumer behavior are often not successful without a large amount of commercial advertising, which is expensive and adds to the cost of a product. In order to create consumer value, advertising and retail displays, or systems or kits of products, should instantly convey to the consumer the area of use and the method of use of a new product.

Consumers may not realize that the dispenser of the invention may contain a hard surface cleaning or other composition that should be used in a one-handed manner with a substrate, for example a sponge. The dispenser is designed to deliver a treatment composition to a substrate such as a sponge over a broad surface area of the substrate. The dispenser is designed to be used while it is sitting on a surface and can be used with one hand. It is not necessary to hold onto the dispenser with one hand and to hold on to the substrate with the other hand. Additionally, it is only necessary that the consumer press down with the substrate on the dispenser to transfer the treatment composition to the substrate.

Figure 7B:
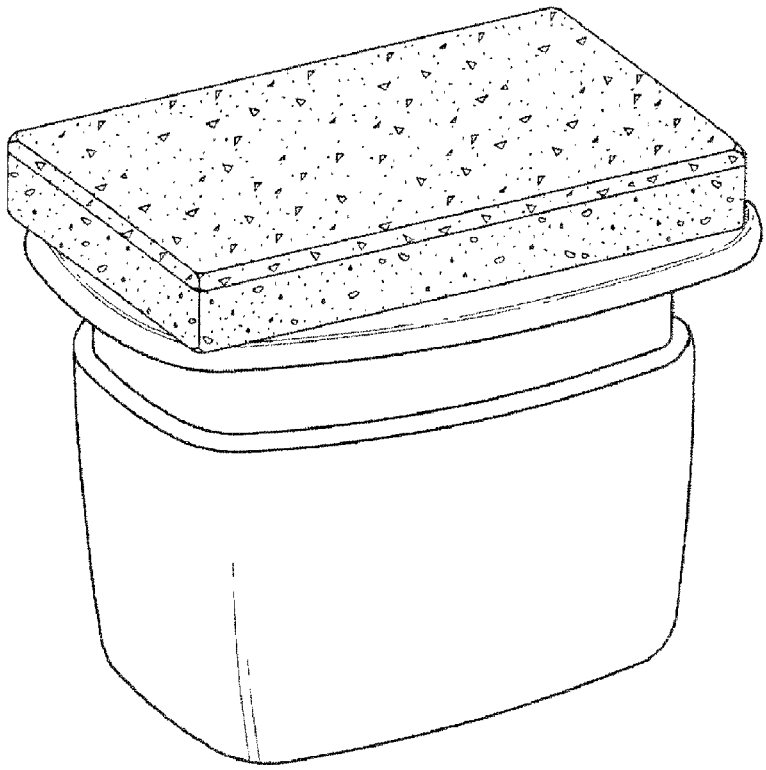
FIG. 7B is a perspective view of an embodiment of a pump dispensing package of the present invention showing a sponge sitting on top of the package.
Figure 7C:
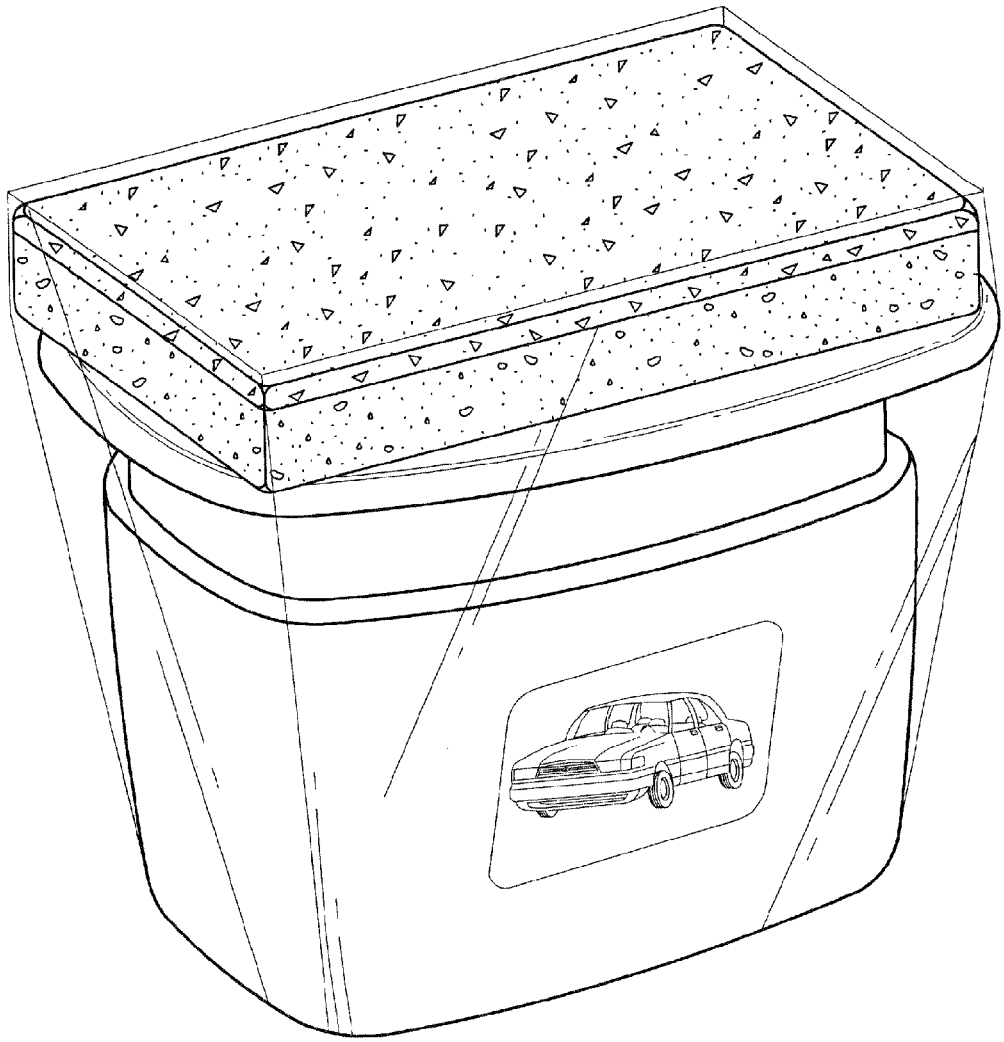
FIG. 7C is a perspective view of an embodiment of a pump dispensing package of the present invention showing a sponge sitting on top of the package and the sponge and package wrapped together.
Figure 9:
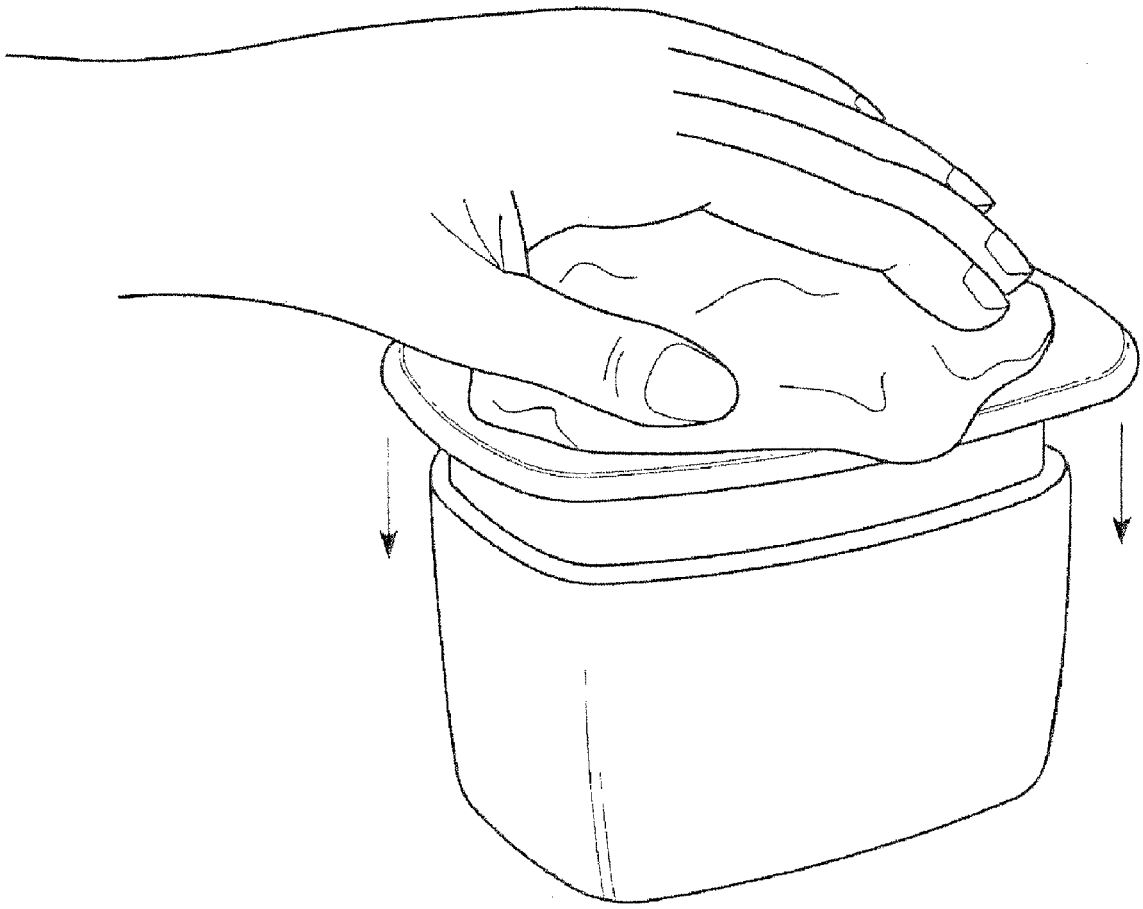
FIG. 9 shows the one-handed use of the package with a paper towel.

In order to instantly convey the method of use of the dispenser of the invention, it may be desirable to show the dispenser together with a substrate, such as a sponge, on top of the dispenser as shown in FIG. 7B. The dispenser together with the substrate, such as a sponge, on top of the dispenser may also be packaged together, for example in a clear package as shown in FIG. 7C. By packaging a sponge on top of the dispenser, the consumer instantly grasps that the dispenser can be used with a sponge to clean a hard surface. The packaging may additional contain indicia of its use for a variety of surfaces, such as counter-tops, kitchens, bathrooms, laundry items, and for automobiles, as shown with the automobile indicia in FIG. 7C. The consumer also notes that the sponge and the dispenser top are approximately the same size, or have substantially the same X-Y dimensions. This conveys to the consumer that the dispenser will likely deliver the treatment composition to a large surface area of the substrate or sponge. The consumer can also note that the concave surface of the dispenser top may allow the treatment composition to collect on the surface of the dispenser top or to drain back into the dispenser. The consumer now understands what to use this novel dispenser for but may still not understand exactly how to use the dispenser. Showing one hand above the substrate and the dispenser, as shown in FIG. 9, instantly conveys to the consumer that the dispenser can be used in a one-handed method. It may also convey that the consumer should push down with the substrate in one hand on the dispenser. To further educate the consumer, it may be necessary to provide additional indicia, for example arrows or other symbols as shown in FIG. 9, that the consumer should push down on the dispenser.

In one embodiment the invention comprises an advertising display comprising a first product, such as a vertical pump-up dispenser, comprising a container having an actuator and a fluid distribution system, wherein the fluid distribution system comprises a tube delivering fluid to the actuator top surface, wherein depression of the actuator causes fluid to travel through the tube toward the actuator top surface, and wherein a subsystem of the fluid distribution system delivers fluid to an area of the actuator top surface greater than the circumferential area of the tube; a second product positioned above the first product and comprising a substrate; and a consumer hand above the second product. The advertising display may additionally shows indicia that the consumer hand should press down on the first product with the second product. The advertising display may show the second product as a sponge, towel, non-woven wipe, bathroom tissue, facial tissue, or other substrate.

In one embodiment the invention comprises a retail display for a set of products comprising a first product comprising a container having an actuator and a fluid distribution system, wherein the fluid distribution system comprises a tube delivering fluid to the actuator top surface, and wherein depression of the actuator causes fluid to travel through the tube toward the actuator top surface, wherein a subsystem of the fluid distribution system delivers fluid to an area of the actuator top surface greater than the circumferential area of the tube; a second product comprising a substrate; and packaging for the set of products; wherein the actuator top is concave; wherein the second product sits on top of the actuator top surface and is held in place by the packaging as part of the retail display. The retail display may additionally have the actuator top surface and the substrate surface having approximately the same surface area, or substantially the same X-Y dimensions. The retail display may have the ratio of the X-Y area of the actuator top surface and the X-Y area of the substrate surface that is from 0.8:1 to 1:0.8. The retail display may have the second product as a sponge, towel, non-woven wipe, bathroom tissue, facial tissue, or other substrate. The retail display may have the second product as a substrate that does not have a handle. The retail display may have a packaging showing an illustration of the second product sitting on top of the first product and a consumer hand above the second product. The retail display may have packaging that additionally shows indicia that the consumer hand should press down on the second product. The retail display may have a product dispenser with a subsystem that is selected from the group consisting of a manifold type distribution subsystem, a spray type distribution subsystem, and a surface distribution channel type distribution subsystem.

Package

FIG. 1 illustrates a package 20 employing an actuator 24, a pump assembly 26, and a dip tube 28 installed on a container 22. In this embodiment, the container 22 is transparent and contains a cleaning composition 21.

Figure 2:
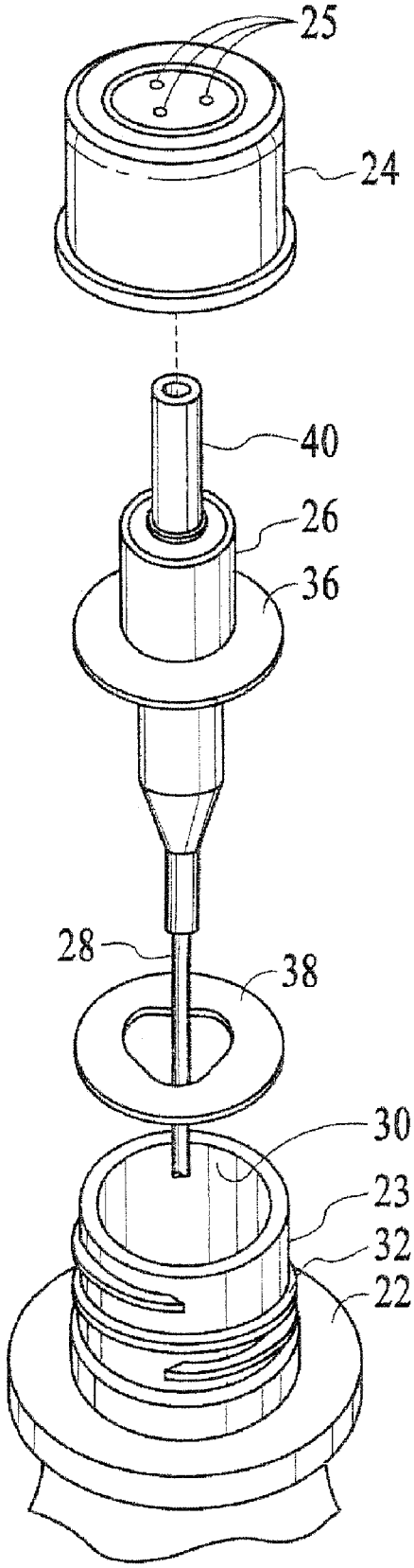
FIG. 2 is a fragmentary, exploded, perspective view of the package illustrated in FIG. 1.

FIG. 2 illustrates a typical pump assembly 26 that may be employed on the container 22 and which is adapted to be mounted in the neck 23 of the container 22. The exterior of the container neck 23 typically defines the threads 32 for engaging the closure (not shown) as described in detail hereinafter. The threads 32 define a connection feature adjacent the container mouth 30. Other connection features may be employed in cooperation with mating or cooperating connection features on the closure, and such other connection features could be a snap-fit bead and groove arrangement or other conventional or special connection features, including non-releasable connection features such as adhesive, thermal bonding, staking, etc.

A part of the pump assembly 26 may extend into the container opening or mouth 30. The pump assembly 26 may be of any suitable conventional or special type. With a typical conventional pump assembly 26, the bottom end of the pump assembly 26 is attached to a conventional dip tube 28, and the upper end of the pump assembly projects above the container neck 23. The pump assembly 26 includes an outwardly projecting flange 36 for supporting the pump assembly 26 on the container neck 23 over a conventional sealing gasket 38 which is typically employed between the pump assembly flange 36 and container neck 23. Other sealing designs such as plug seals can be used in place of a gasket. The hollow stem or tube 40 establishes communication between the pump chamber (not shown) within the pump assembly 26 and an actuator 24 which is mounted to the upper end of the tube 40.

Figure 10:
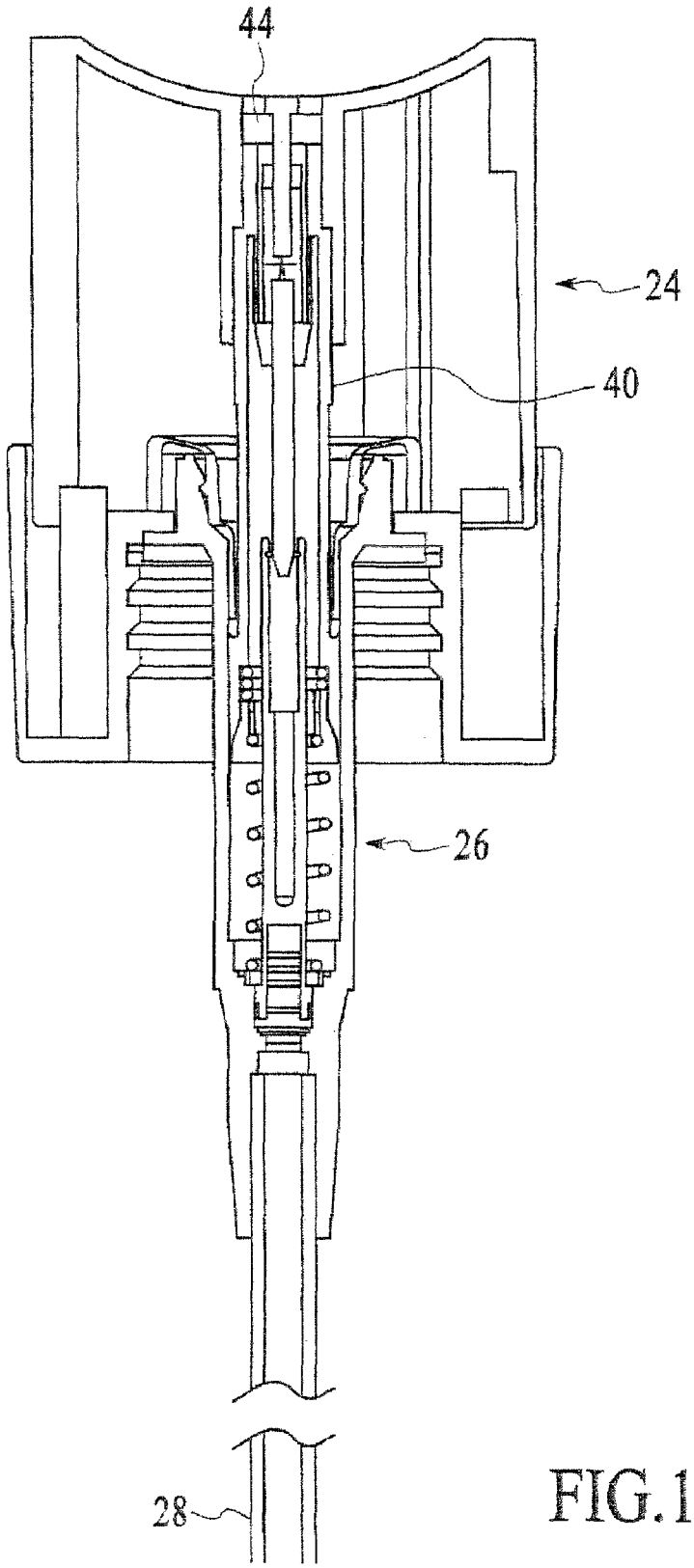
FIG. 10 is a cross-sectional view of an embodiment of the pump dispenser of the present invention taken generally along the plane 10-10 in FIG. 1.

The actuator 24 defines a discharge passage 44 (FIG. 10) through which the product from the stem or tube 40 is discharged. The actuator 24 has a hand-and-substrate engageable region (FIG. 9) and can be depressed by the user's hand containing a substrate to move the stem 40 downwardly (FIG. 10) in the pump assembly 26 to dispense fluid from the pump assembly 26. The fluid is pressurized in the pump chamber and exits from the actuator orifices 25 (FIG. 2) in the actuator 24.

It will be appreciated that the particular design of the pump assembly 26 may be of any suitable design for pumping a product from the container 22 (with or without a dip tube 28) and out through the stem 40. The detailed design and construction of the pump assembly 26 per se forms no part of the present invention except to the extent that the pump assembly 26 is adapted to be suitably mounted and held on the container by a closure with a suitable mounting system.

While the present invention may be practiced with spray or liquid pumps of many different designs, the internal design configuration of one suitable pump is generally disclosed in U.S. Pat. No. 4,986,453, the disclosure of which is hereby incorporated herein by reference thereto. It should be understood, however, that the present invention is suitable for use with a variety of hand-operable pumps.

Container

Figure 5:
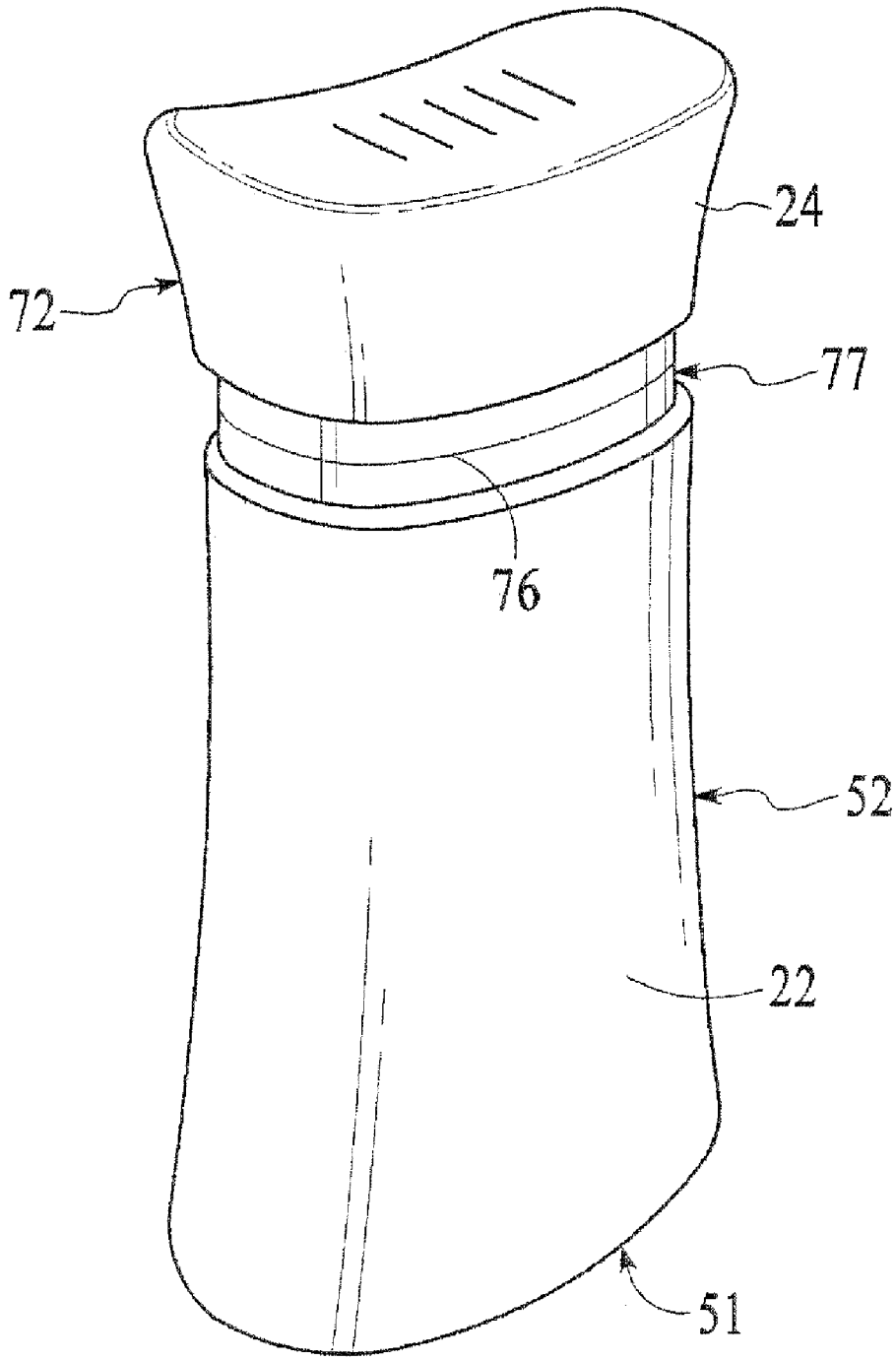
FIG. 5 is a perspective view of an embodiment of a pump dispensing package of the present invention, and the package is shown assembled in a condition prior to use.

The dispensing package (FIG. 5) can comprise a container 22 having a container bottom 51; a container sleeve 52 coupled to said container bottom 51 and depending upwardly from the peripheral edge of said container bottom 51; an actuator 24 having an actuator top 72 and an actuator skirt 76 coupled to the actuator top 72 and depending downwardly from the peripheral edge of said actuator top 72; a pump assembly 26 (FIG. 2) having a hollow stem 40 and the pump assembly 26 disposed within the container 22 and in fluid communication with the actuator 24; wherein the actuator 24 has at least one discharge orifice 25 in fluid communication with the stem 40 of the pump assembly 26 to permit liquid to flow on to a top surface 74 (FIG. 7A) of the actuator top 72 upon reciprocation of the actuator top 72, and wherein a sleeve interior surface of the container sleeve 52 is slideably engagable with a skirt exterior surface 77 of the actuator skirt 76 (FIG. 5).

Figure 3:
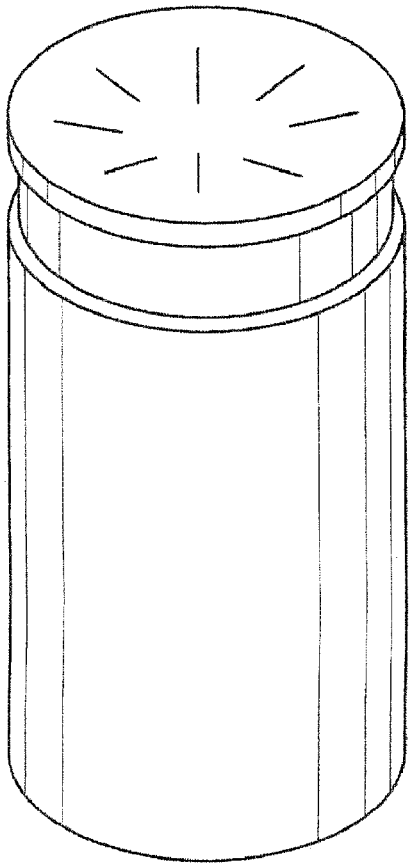
FIG. 3 is a perspective view of an embodiment of a pump dispensing package of the present invention, and the package is shown assembled in a condition prior to use.
Figure 4:
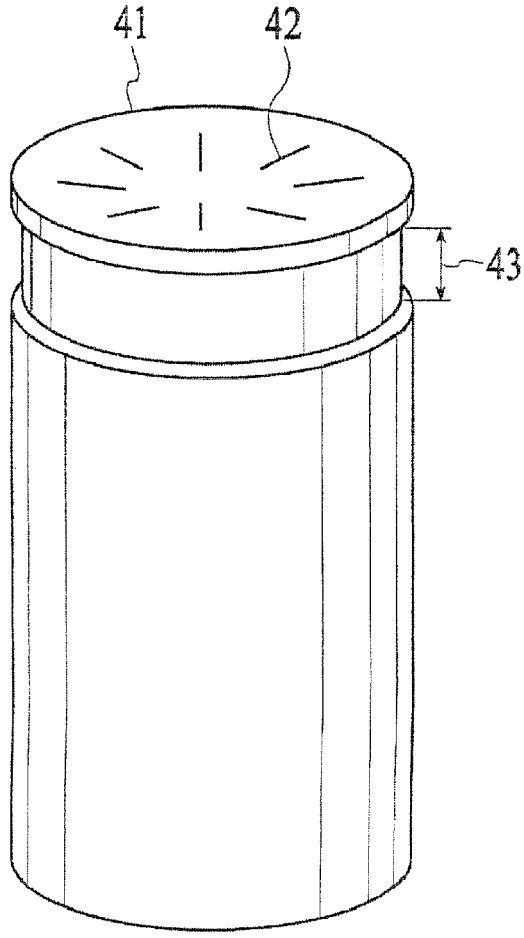
FIG. 4 is a perspective view of an embodiment of a pump dispensing package of the present invention, and the package is shown assembled in a condition prior to use.

The container can have a variety of shapes. The container can be round (FIG. 3) or oval (FIG. 4) or rectangular with rounded corners (FIG. 7A). The container dimensions can be measured from a horizontal slice 75 (FIG. 7A). The container can be made from plastic materials. The container, and other components of the dispenser package, can be constructed of any of the conventional material employed in fabricating containers, including, but not limited to: polyethylene; polypropylene; polyacetal; polycarbonate; polyethylene-terephthalate; polyvinyl chloride; polystyrene; blends of polyethylene, vinyl acetate, and rubber elastomer. Other materials can include stainless steel and glass. A suitable container is made of clear material, e.g., polyethylene terephthalate.

Actuator

The ergonomic shape of the actuator makes the actuator easy to pump with a substrate such as paper towel or sponge, and to operate using one hand. One measure of the actuator shape is a vertical projection 71 (FIG. 7A) of the top surface 74 of the actuator top 72, where a vertical projection is a projection onto the horizontal plane. The vertical projection 71 has a length 78 and a width 79. The aspect ratio is the ratio of the length to the width. For a circle, the aspect ratio would be 1. Unless the hand or the substrate in the hand is severely compressed, then both the hand and substrate would have an aspect ratio greater than 1. In order to ergonomically apply the composition to the substrate in the hand, in some embodiments of the invention it would be desirable for the actuator and or the pattern of orifices to have an aspect ratio greater than 1. The vertical projection of the actuator top can have an aspect ratio of greater than 1, or greater than 1.1, or greater than 1.2, or greater than 1.5, or at least 1.1, or at least 1.2, or at least 1.5, or less than 2, or less than 1.5. In order to provide a large surface for one-handed use of the dispensing package, in some embodiments, the actuator top size can be approximately the same size or larger than the container. The actuator top size can be larger than the width of two fingers for easy ergonomic use with a cleaning substrate. The vertical projection of the actuator top length can be larger than about 1.5 inches, or from 2 to 10 inches, or from 2 to 8 inches, or from 2 to 5 inches, or from 2 to 3 inches, or from 2.5 to 8 inches, or from 2.5 to 5 inches, or from 2.5 to 3 inches. The vertical projection of the actuator top can have an area of greater than 2 square inches, greater than 5 square inches, greater than 6 square inches, greater than 7 square inches, greater than 8 square inches, greater than 10 square inches, less than 8 square inches, less than 10 square inches, or less than 20 square inches. For use with a semi-rigid rectangular substrate, for example a sponge, the actuator top can be approximately the same size or somewhat smaller than a standard rectangular sponge, for example about 2.5 by about 4.5 inches. The vertical projection of the top surface of the actuator top can have at least one dimension that is greater than the corresponding dimension of any horizontal slice 75 of the container (FIG. 7A). The vertical projection of the top surface of the actuator top can have at least one dimension that is greater than the corresponding dimension of any horizontal slice 75 of the actuator skirt (FIG. 7A).

Figure 6:
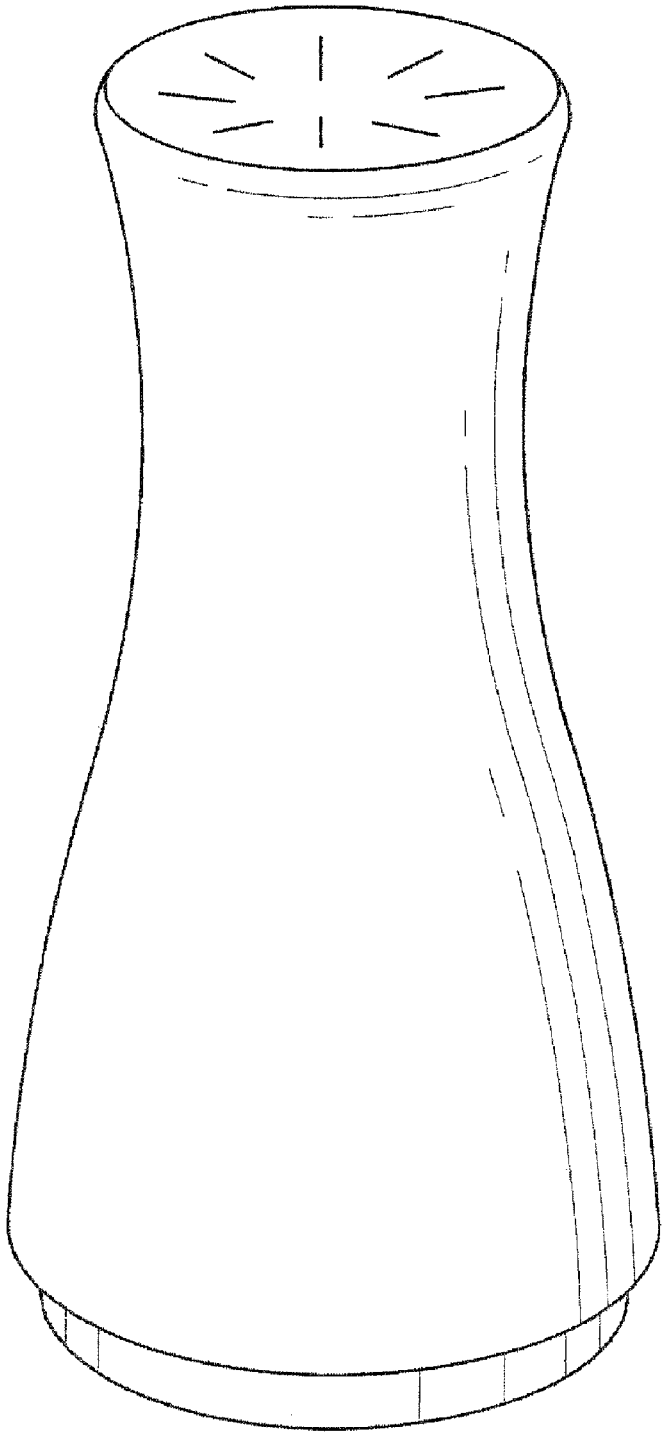
FIG. 6 is a perspective view of an embodiment of a pump dispensing package of the present invention, and the package is shown assembled in a condition prior to use.
Figure 8:
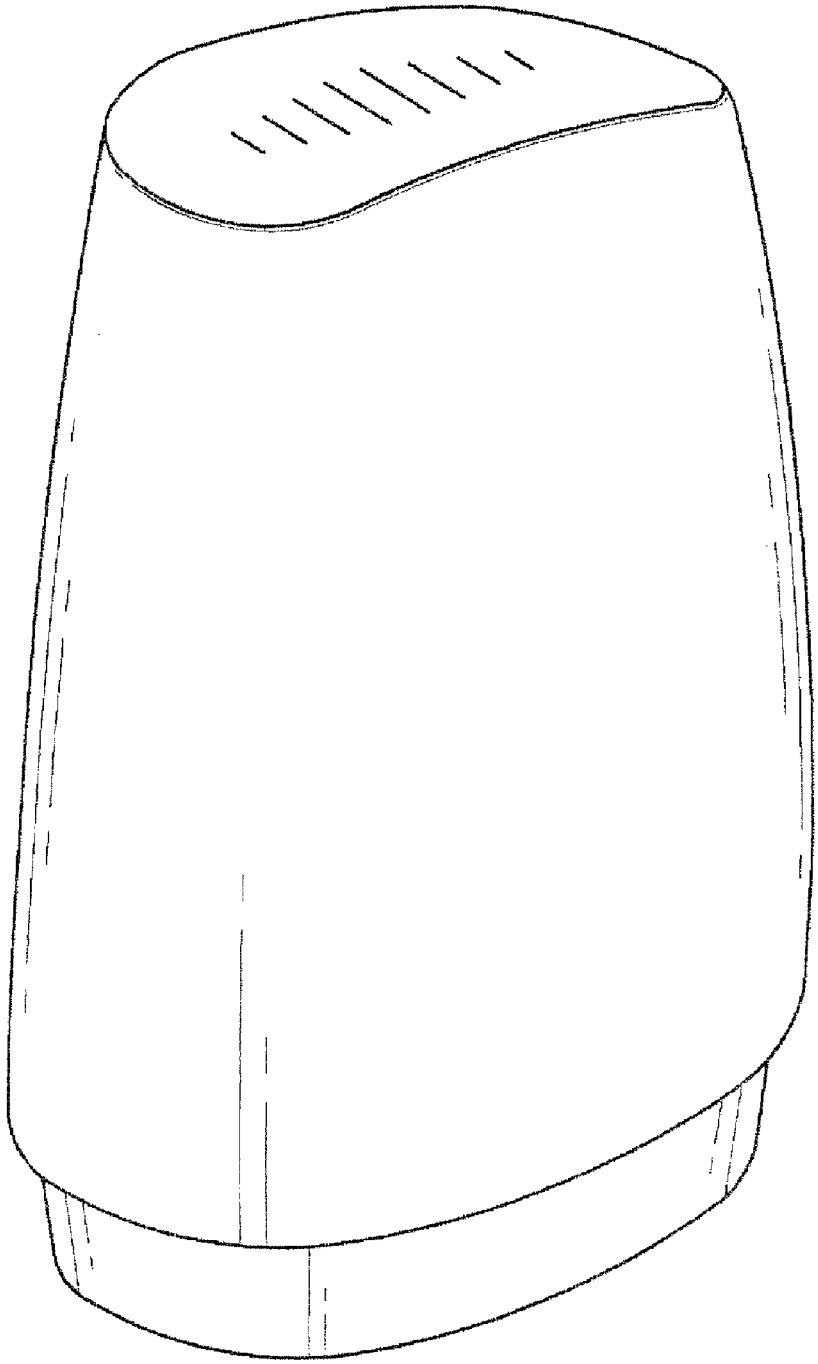
FIG. 8 is a perspective view of an embodiment of a pump dispensing package of the present invention, and the package is shown assembled in a condition prior to use.

The actuator can have a concave shape that is round (FIG. 3, FIG. 6), oval (FIG. 4, FIG. 5, FIG. 8), a rectangular with rounded corners (FIG. 7A), elliptical, or other shape that fits the hand, a sponge, or other substrate. The concave shape allows the capture or excess composition without dripping. In certain embodiments, it may be desirable to allow pools of the composition to collect in the actuator top 42 (FIG. 4) during use. The actuator can have a rim 41 to prevent spillage. In certain embodiments, it may be useful for the actuator to be flat or convex for ergonomic effectiveness with certain substrates.

The actuator can individually be adapted to the respective requirements with regard to the direction of the dispensing opening as well as with regard to the use of opening valves. The actuator is not limited to having a dispensing opening which is moved together with a dispensing key, but it may also comprise an actuator of the type having a stationary dispensing opening. The actuator may have a surface that engages the container and is internal (FIG. 4) or external (FIG. 6, FIG. 8) to the container.

Actuator Skirt

The actuator skirt can be indented from the actuator top (FIG. 7A). The actuator skirt dimensions can be measured from a horizontal slice of the actuator skirt 76. Because this dispenser package may be unfamiliar to consumers, it may be necessary to provide a consumer cue on how to use the dispenser package by pushing down on the actuator. Therefore, before activation of the package, it may be desirable that a portion of the actuator skirt is visible to a user of the package thereby providing operational indicia to the user of the package. This provides a consumer cue to push down on the actuator. It may be desirable that before activation, the visible portion of the actuator skirt has a vertical dimension 43 (FIG. 4) of about one-eighth inch, at least one-eighth inch, or at least one-quarter inch, or at least one-half inch, or at least one inch. By the same notion, it may be desirable that after downward activation of the package, the actuator top extends beyond the circumference of the container (FIG. 7A). An actuator skirt that is indented from the actuator top or is a different color from the actuator top or the container may provide a consumer cue as to how to use the dispensing container.

Actuator Orifices

The package can have one or more openings or orifices 25 situated on the actuator 24 (FIG. 2). The orifice can be a small or large, round, slit or other suitable shape. The orifice or orifices can be centered in the actuator. Because the actuator is enlarged, the orifice or orifices can be located away from the edge of the actuator to prevent, for example, spilling the composition. The actuator top can have multiple orifices and the orifices can be indented from the exterior edge of the top surface of the actuator top. The actuator top can have multiple orifices wherein the pattern of orifices has an aspect ratio of at least 1.5, or greater than 1, or greater than 1.1, or greater than 1.2, or greater than 1.5, or at least 1.1, or at least 1.2, or less than 2, or less than 1.5. Where the pattern of orifices has an aspect ratio of at least 1.5, then the composition can be applied to the substrate in an area having an aspect ratio of at least 1.5, or greater than 1, or greater than 1.1, or greater than 1.2, or greater than 1.5, or at least 1.1, or at least 1.2, or less than 2, or less than 1.5. When for example the actuator top is large and has multiple orifices, the actuator can apply at least 0.3 ml of the composition (or other volume) to the substrate in an area of greater than 2 square inches and less than 20 square inches, or an area of greater than 4 square inches, greater than 5 square inches, greater than 6 square inches, greater than 7 square inches, greater than 8 square inches, greater than 10 square inches, less than 8 square inches, less than 10 square inches, or less than 20 square inches.

Delivery Volume

The delivery or application volume should give satisfactory delivery of the composition in one stroke of the actuator component. For consumer flexibility, the consumer may also use more than one stroke of the actuator component for the treatment of large areas or heavy cleaning tasks. A suitable delivery volume is 0.1 to 5 ml, or 0.1 to 1 ml, or 0.1 to 0.5 ml, or 0.3 to 0.5 ml, or 0.3 to 1 ml, or 0.5 to 5 ml, or 0.5 to 1 ml, or 1 to 5 ml, or 1 to 2 ml, or about 0.3 ml, or about 0.7 ml.

Locking Means/Cover

The dispensing package may have a flip-top cover as described in U.S. Pat. No. 6,953,297 to Dobbs et al. The dispensing package may have a retractable cover as described in U.S. Pat. No. 6,223,951 to Siegel et al. The dispensing package may have a rotatable or removeable sleeve to prevent actuation as described in U.S. Pat. No. 6,543,649 to Danielo et al. The dispensing package may have a rotative locking mechanism or a removable anti-rotative lock as described in U.S. Pat. No. 5,445,299 to Harriman.

Durable or Disposable Package

The package may be disposable and designed for one use and not designed to be refillable. In this embodiment, the actuator and/or pump assembly may be fused to the container, for example with spot welding.

The package may be durable and able to be refillable. In one embodiment, the package is refilled by pouring additional composition into the container through a neck opening in the container. In one embodiment, a durable pump assembly and actuator is attached to a disposable container assembly containing a composition. In one embodiment, a durable pump assembly, actuator and container assembly is adapted to allow attachment of a refill container.

Refill Assembly

In some embodiments, the dispenser package can be refilled with a refill assembly. In order to prevent attaching a refill that may be inappropriate for the actuator or the intended use, in some embodiments the refill is designed to have novel characteristics. For example, the refill assembly may be coupled to the actuator using a non-standard closure. In one embodiment, either a rigid cartridge or flexible pouch is inserted into a rigid container with some mechanism to attach the pump and actuator. The attachment mechanism can be, for example, that the pump and actuator is inserted into a refill with a film seal, for example as described in U.S. Pat. No. 6,269,976 to DeJonge which describes a puncture spike with a dip tube guide. In another embodiment, the refill assembly has a restricted neck to discourage refilling by the consumer.

Figure 11A:
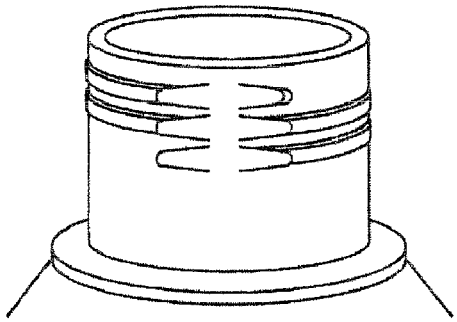
FIGS. 11A and 11B are perspective views of an embodiment of a refill closure of the present invention.
Figure 11B:
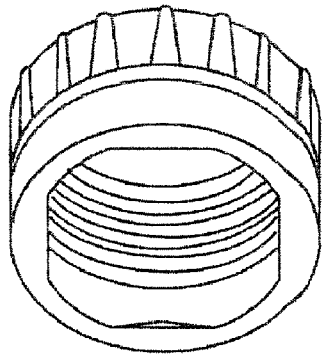

In another embodiment, the refill assembly has a non-standard closure, such as non-standard neck threads or tabs, so that a standard threaded closure cannot be used. One example is a key hole closure which in one embodiment comprises a threaded female fitting, modified so a completely threaded male fitting can not be engaged in the female fitting, and a matching male fitting. The threaded female fitting, such as a bottle closure, has an extended skirt and one or more restrictions in the skirt to prevent a completely threaded male fitting from being used. The skirt is long enough that the matching male fitting can be pushed into the female fitting far enough to clear the restriction before the threads start to engage. FIGS. 11A and 11B show one embodiment of this design. The threads on the male part have been truncated on four sides. The female part has four wedges added at the bottom of the skirt to provide a partially squared opening that matches the cross section of the threaded portion of the male part with enough clearance that the male part can be easily inserted into the female part until the threads start to engage. At that point the threads have cleared the wedges so the two parts can be screwed together.

Figure 12A:
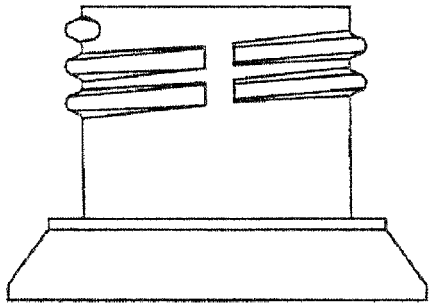
FIGS. 12A and 12B are perspective views of an embodiment of a refill closure of the present invention.
Figure 12B:
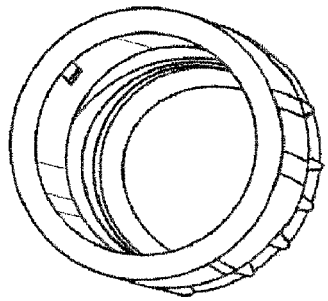
Figure 13A:
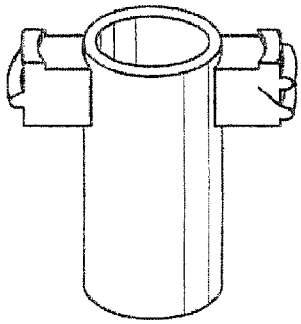
FIGS. 13A and 13B are perspective views of an embodiment of a refill closure of the present invention.
Figure 13B:
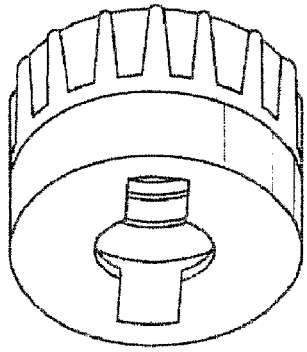

In another embodiment of the key hole closure, the modification to the threads in this case is a 0.10" wide, vertical channel on one face only (FIG. 12A). The matching female part (FIG. 12B) has a protrusion that must slide through the channel on the male part before the threads engage. In another embodiment of the key hole closure, the opening in the male part is smaller diameter than the threads, so the threads project from the sides of the male part (FIG. 13A). The opening in the female part matches the cross section of the male part (FIG. 13B).

Figure 14A:
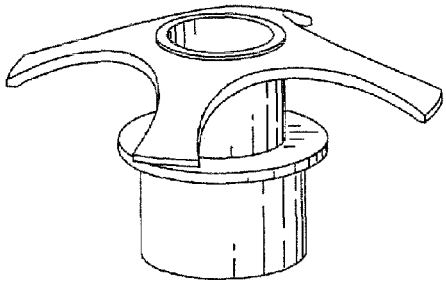
FIGS. 14A and 14B are perspective views of an embodiment of a refill closure of the present invention.
Figure 14B:
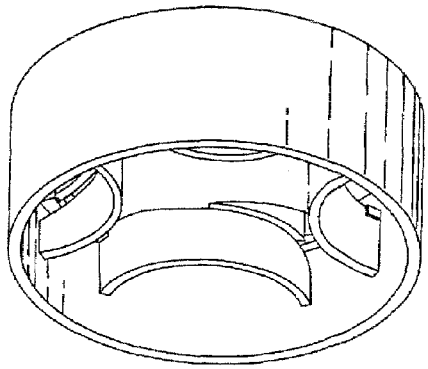

In one embodiment, a flex closure has a male part with a neck of any cross section shape, which may attach to a container and be hollow to allow access to the container (FIG. 14A). One or more arms protrude from the side of the neck. Prior to connection with the female part, the arms of the male part angle or are curved down. The female part has a central opening large enough to accept the neck of the male part and allow it to rotate (FIG. 14B). The female part also has open channel(s) which allow the protruding arm(s) to be inserted into it. When the female part is turned relative to the male part to connect the parts, the protruding arm first passes through a slot that matches the cross section of the arm and then engages with a ramp that bends the arms upward. The ramp flattens out when the ends of the arms are bent the desired amount. In one embodiment, the arms are bent enough that they end up above the channel that allowed the preceding arm to be inserted into the female part. FIG. 14A shows one embodiment of the male part. This is a bottle fitment and the lower part has a tight fit in the neck of the bottle. There are four arms that curve downward. FIG. 14B shows the female part. The outer surface is a cylinder and there are four partial cylinders on the interior. The space between the partial cylinders provides channels for the arms to enter the female part. Each of the partial cylinders has a slot that allows the arm to be turned until it is inside the partial cylinder. Once the end of the arm clears the partial cylinder wall, the inner portion of the partial cylinder wall ramps up and bends the arms up as the male part continues to turn relative to the female part. The male part can continue to turn until the arm is stopped by the wall of the next partial cylinder. At this point the arm is supported on an annular ring that is the flat portion of the ramp and the arm is above the entry channel for the next arm.

Figure 15:
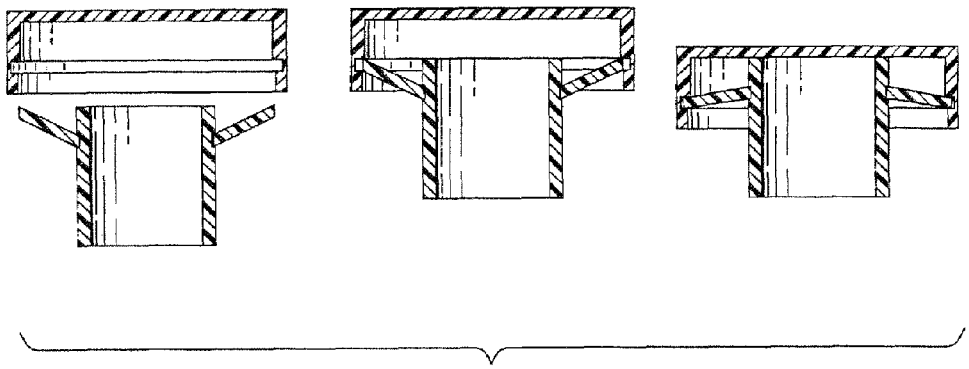
FIG. 15 shows three cross-sectional views of an embodiment of a refill closure of the present invention.

In one embodiment, a flip closure is a connection system with male and female parts (FIG. 15). The parts are pushed together along a central axis to make the connection. The male part has a neck of any cross section shape parallel to the central axis. The neck can be solid or hollow and if hollow can be connected to a container and allow access to the container. Either the male or female part has one or more arms protruding from it and angled toward the second part before they are connected. The second part has two or more surfaces extending radially toward the first part when the parts are connected. These surfaces are perpendicular enough to the central axis to keep the arms from sliding past them. The length of the arms allows the parts to be pushed together until the arms contact one extending surface on the second part. As the parts continue to be pushed together the arms bend or rotate until they are angled away from the direction they were initially angled and are prevented from moving by a second extending surface. The second extending surface does not extend as far as the first surface, so the arms do not contact it until they are partially bent or rotated. The length of the arms is such that compression on the arms from contact with the second part increases and then decreases as the connection is made so that the final position of the two parts is stable. The arms are held to the first part by one or more hinges, or are integral to the first part and flexible enough to bend, or the ends of the arms are prevented from sliding parallel to the central axis by surfaces extending radially toward the second part. The three drawings (FIG. 15) are cross sections of the two parts which illustrate an embodiment of this design where the neck is a hollow cylinder and the arms are connected to the male part. The arms are scored where they connect to the neck to control where they bend. The first drawing shows the parts before connection. The second drawing shows the parts as the arms initially contact the first extended surface. The third drawing shows the completed connections with the arms angled away from their initial position and contacting the second extended surface.

Figure 16:
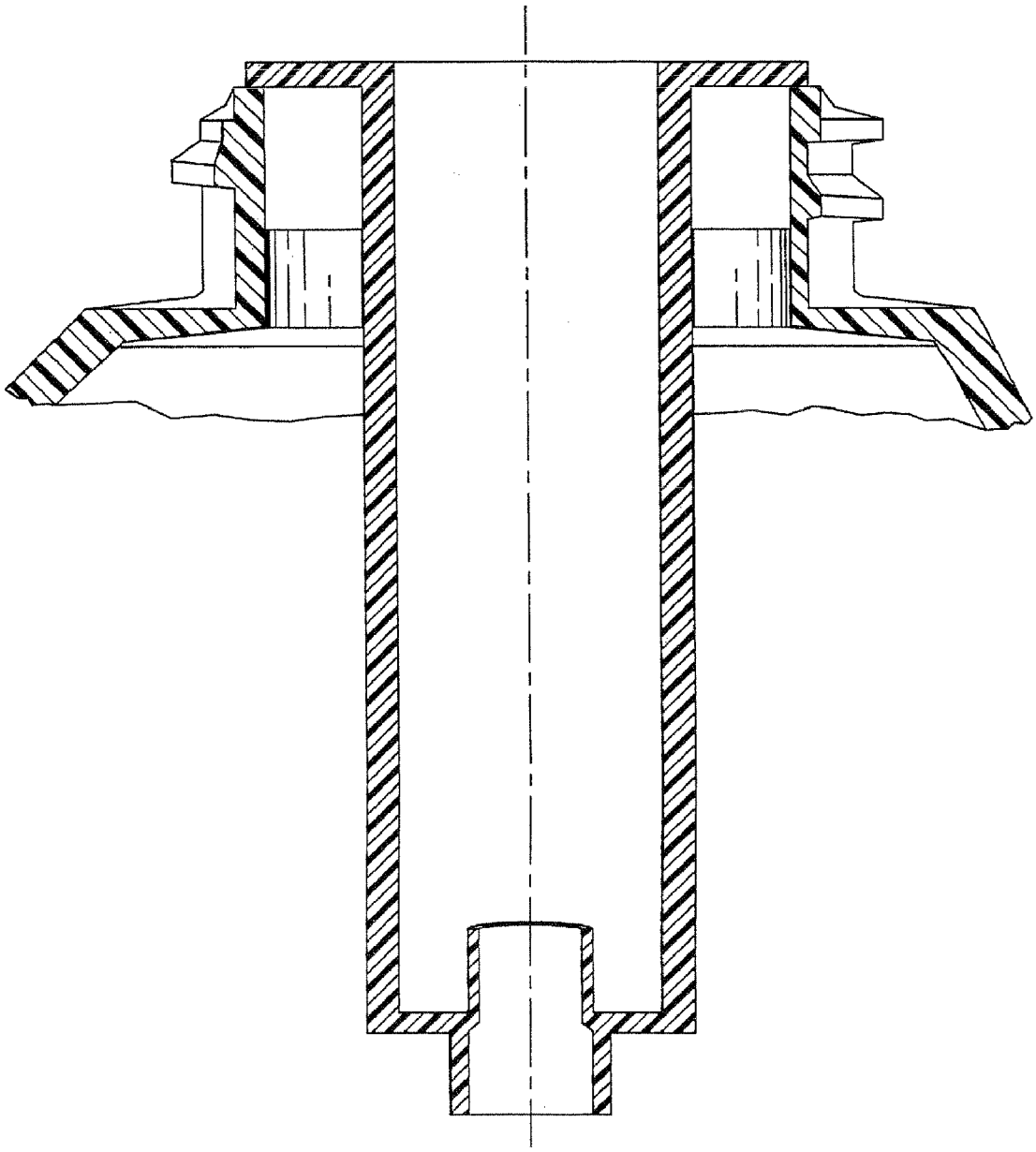
FIG. 16 shows a cross-sectional view of an embodiment of a refill closure of the present invention.

In one embodiment, the fitment closure (FIG. 16) is used with a fluid dispenser that is fed from a dip tube, such as a lotion pump or trigger sprayer. The dip tube, and possibly additional parts of the fluid dispenser such as the check ball, are attached to a fitment which holds the dip tube in place in the container which the fluid dispenser is attached to. The fitment can be attached to the container or simply held in place between the fluid dispenser and container when they are connected. The fitment has a means of attaching a dip tube, such as a socket the dip tube fits into or a male extension the dip tube fits around. The fitment also has a means of sealing it to the fluid dispenser tightly enough that fluid will pass through the dip tube when the fluid dispenser is actuated. The drawing shows one embodiment of the fitment design. The fitment is shown in position in a bottle neck but without the dip tube. The top portion of this design has a skirt sized to friction fit in the bottle's neck. The socket at the bottom of the drawing accepts a dip tube. The adjacent protrusion inside the fitting fits into the dip tube socket on a lotion pump.

In another embodiment, the container has a closure that is broken off when the consumer removes the container so that it cannot be reattached. In another embodiment, the refill has a flange and offset opening in the neck, for example as described in U.S. Pat. No. 6,702,157 to Dobbs. In other embodiment, the refill has a specifically designed vent opening to mate with the actuator pump assembly, for example the cap vent assembly as described in U.S. Pat. No. 5,181,635 to Balderrama et al. In another example, the refill container has locking rachet teeth, for example as described in U.S. Pat. No. 5,360,127 to Barriac et al.

Multiple Compartments

The package may have a swivel actuator that allows selection from multiple compartments as described in U.S. Pat. 2003/0192913 to Preuter et al. The package may have multiple actuator components for delivering multiple compositions from one container having multiple compartments, for example a hard surface cleaner and a dish soap.

Fluid Distribution System

When the actuator orifices cover a large area, it may be desirable to have a fluid distribution system to deliver the fluid from the hollow tube 40 to the orifices 25 (FIG. 2). As described in more detail below with reference to FIG. 17A through FIG. 25B, the fluid distribution systems of the present invention may include, for example, a manifold type distribution subsystem, a spray type distribution subsystem, or a surface distribution channel type distribution subsystem. Irrespective of the particular foregoing subsystem, the fluid distribution system of the present invention may deliver fluid to an area of the top surface of an actuator top greater than the circumferential or cross-sectional area of the tube 40. As used herein, the term "fluid distribution system" refers to a system for dispensing a fluid delivered to the system (such as by pump assembly 26) to a desired location (such as the top surface 74 of an actuator top 72).

Figure 17A:
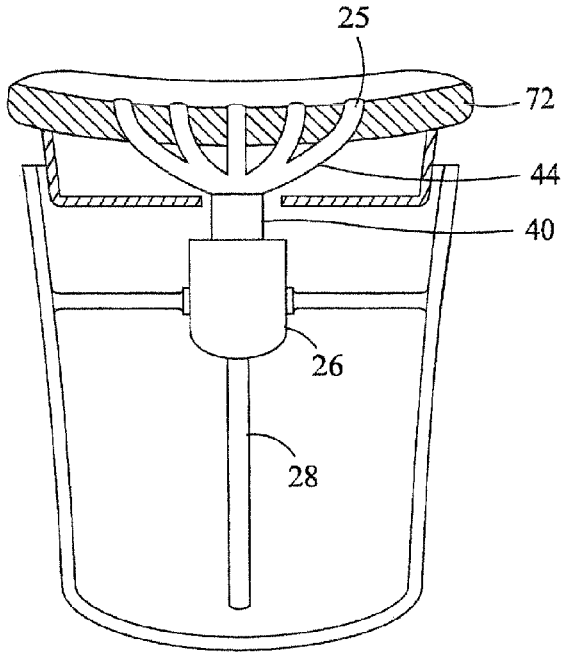
FIG. 17A shows a cross-sectional view of an embodiment of a pump dispensing package having a fluid distribution system of the present invention.

FIG. 17A shows an embodiment of the present invention with a manifold type subsystem where channels 44 are utilized to move the fluid to the surface with orifices 25 organized over the channel openings. In one embodiment, the channel paths are all the same distance so that fluid is evenly distributed with every pump.

Figure 17B:
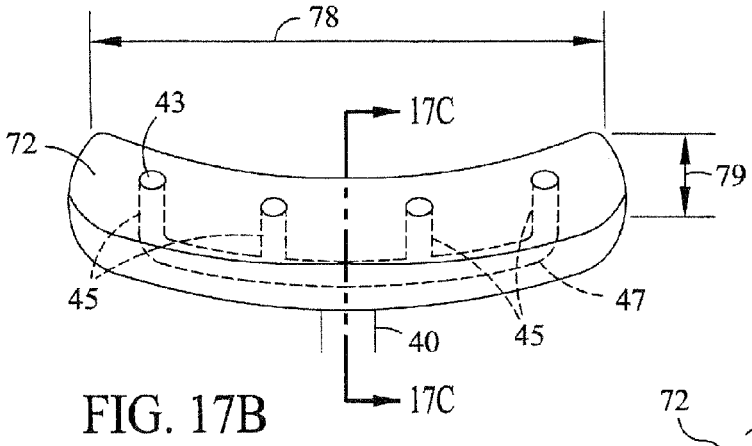
FIG. 17B shows a cross-sectional view of an embodiment of a fluid distribution system of the present invention.

FIG. 17B shows an embodiment of a manifold type distribution subsystem where a plurality of vertical channels 45 are each attached to a respective lengthwise manifold 47 that spans nearly the entire length 78 of the vertical projection 71 of the actuator top 72. In one embodiment of the present invention, four channels 45 are attached to the lengthwise manifold 47 with the four channels 45 substantially equally spaced across the length 78 of the vertical projection 71 of the actuator top 72. Typically, between 2 and 12 channels 45 may be attached to the lengthwise manifold 47.

Channels 45 may fluidly connect the tube 40 with the corresponding orifices 43. The orifices 43 may span a significant portion of the actuator top 72, thereby providing fluid flow to an area of the actuator top 72 larger than the diameter of the tube 40. Typically, the orifices 43 may span between about 60 to about 95% of the length 78 of the top surface 72.

Figure 17C:
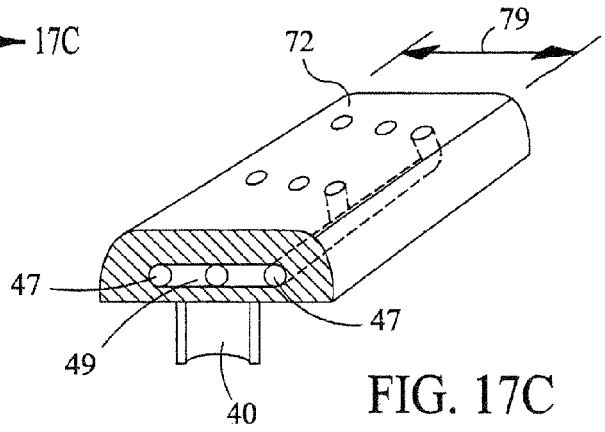
FIG. 17C shows a cross-sectional view of an embodiment of a fluid distribution system of the present invention.

FIG. 17C shows an embodiment of a manifold type distribution subsystem where multiple lengthwise manifolds 47 are fluidly connected to the hollow stem 40 via a respective widthwise manifold 49. For example, three lengthwise manifolds 47 may be equally spaced across the width 79 of the actuator top 72. Typically, between 2 and 6 lengthwise manifolds 47 may be fluidly connected to the widthwise manifold 49.

Figure 18A:
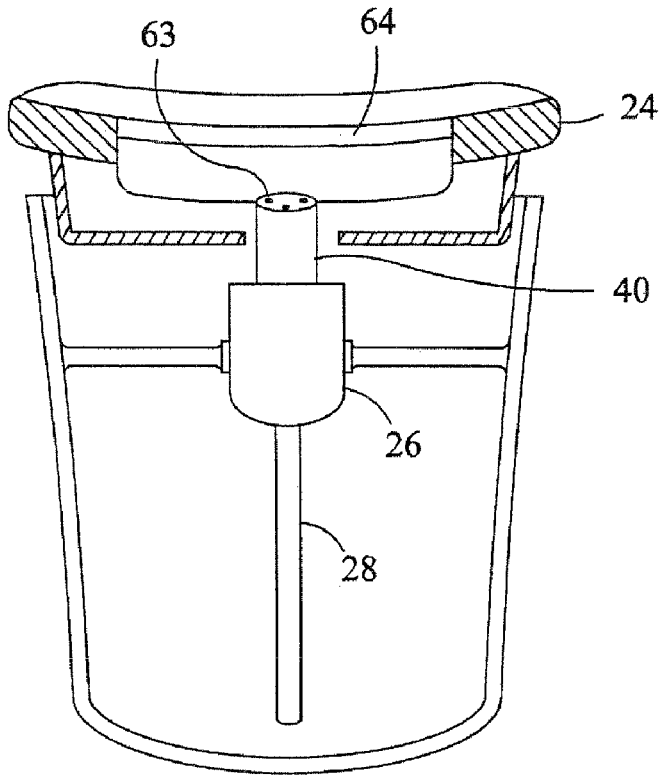
FIGS. 18A and 18B show cross-sectional views of embodiments of a pump dispensing package having a fluid distribution system of the present invention.

FIG. 18A shows an embodiment of the present invention that includes a spray type distribution subsystem having a distribution spacer 63, such as used in trigger and pump sprayers, that splits the main stream into several tiny streams of liquid. This embodiment might include a complex push pad 64 that allows the fine streams to escape through the holes. The pump assembly 26 may deliver fluid to the distribution spacer 63 which may spray the main stream as several tiny streams onto the complex push pad 64. The fine streams may exit through holes (not shown) in complex push pad 64 to reach the substrate which may be on the top of the actuator.

Figure 18B:
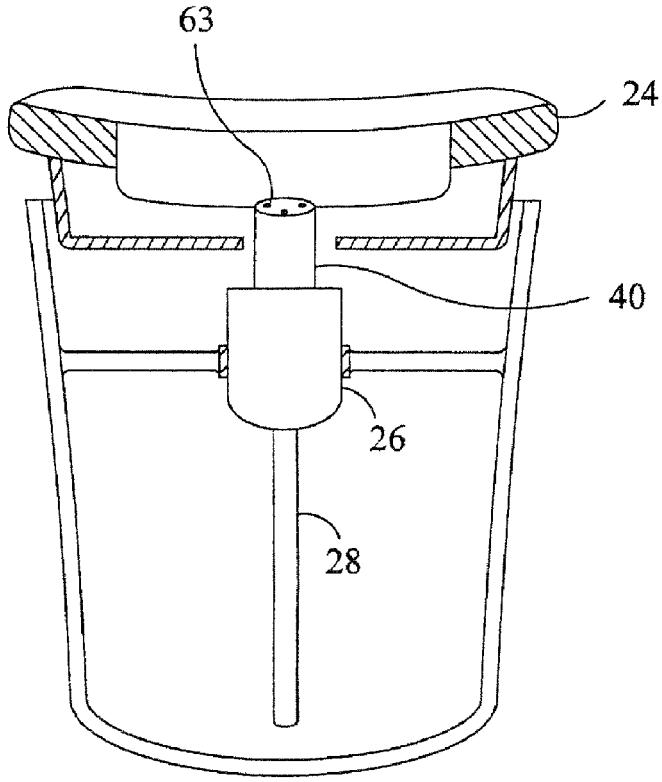

FIG. 18B shows an embodiment of the present invention that includes a spray type distribution subsystem using a fine mist spray approach, similar to that common finger pumps utilize, but with a vertical mist. In this embodiment, the user holds the substrate over the push pad actuator 24, pushes down and the actuation would be a fine mist spray up onto the substrate. The fine mist spray results in a fluid flow contacting the substrate at an area greater than conventional lotion pumps, which may only deliver a fluid in a circumferential area of the tube 40.

Figure 19:
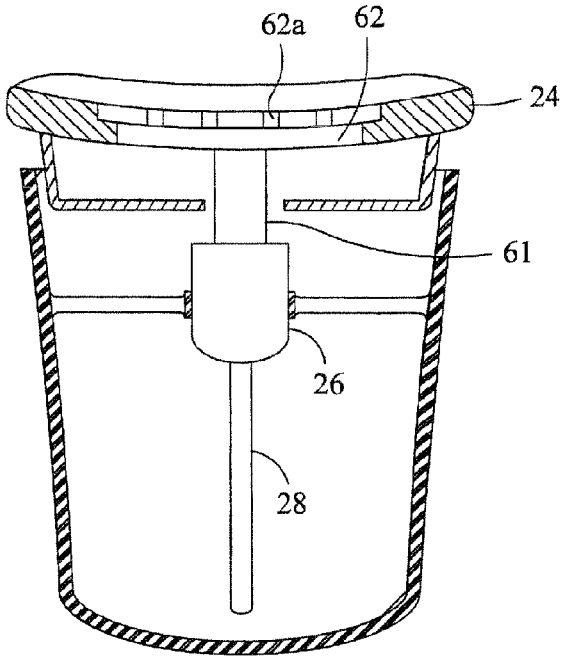
FIG. 19 shows a cross-sectional view of an embodiment of a pump dispensing package having a fluid distribution system of the present invention.

FIG. 19 shows an embodiment of the present invention that includes a fluid distribution subsystem having a shallow fluid reservoir 61 that distributes the fluid to the surface holes 62*a*. The holes 62*a* may deliver the fluid on the press pad 62 in an area greater than conventional methods, which may deliver fluid on the press pad 62 in only the location defined by the circumferential area of the tube 40.

Figure 20A:
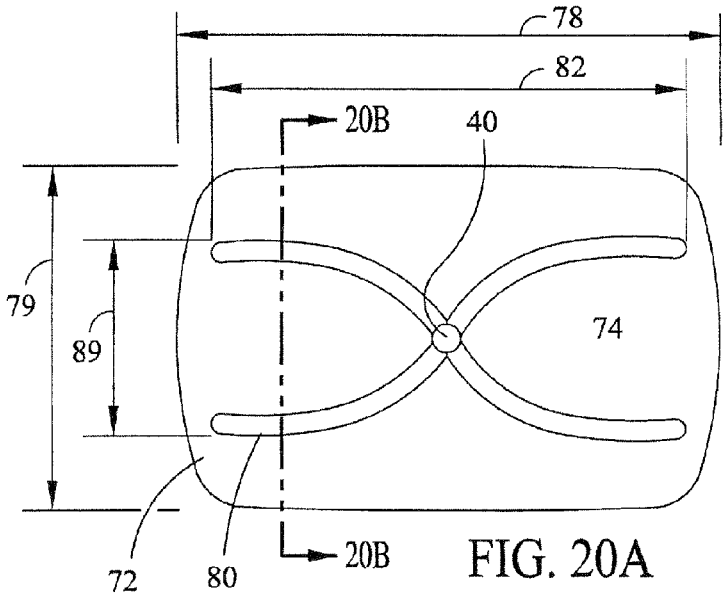
FIG. 20A shows a cross-sectional view of an embodiment of a fluid distribution system of the present invention.

FIG. 20A shows an embodiment of a surface distribution channel fluid distribution subsystem having a surface distribution channel 80 along the top surface 74 of the actuator top 72. Fluid enters the surface distribution channel 80 from the tube 40 when the actuator 74 is depressed. The surface distribution channel 80 may span a portion of the actuator top surface 74. For example, the maximum length 82 of the surface distribution channel 80 across the top surface 74 may be from about 60 to about 95% of the length 78 of the top surface 74. Similarly, the maximum width 84 of the surface distribution channel 80 across the top surface 74 may be from about 60 to about 95% of the width 79 of the top surface 74.

Figure 20B:
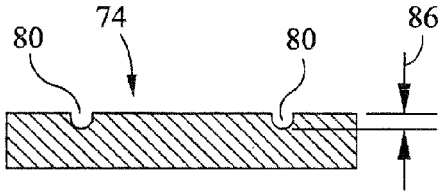
FIG. 20B shows a cross-sectional view along line 20B-20B of FIG. 20A.

FIG. 20B shows a cross-sectional view along line 20B-20B of FIG. 20A. The surface distribution channel 80 may have a depth 86 from about ½ mm to about 10 mm. The actual depth 86 may be chosen depending on the application. A deeper depth 86 may allow more fluid to be dispensed in a single actuation of the pump and may be useful in those applications where a larger volume of fluid is needed. While FIGS. 20A and 20B have an X-shaped surface distribution channel 80, other configurations of the surface distribution channel 80 may be used so long as the surface distribution channel 80 passes over tube 40 and covers an area of the top surface 74 larger than the circumferential area of the tube 40 alone. While the surface distribution channel 80 is shown as being semi-circular, any cross-sectional shape may be useful in the present invention.

Figure 21A:
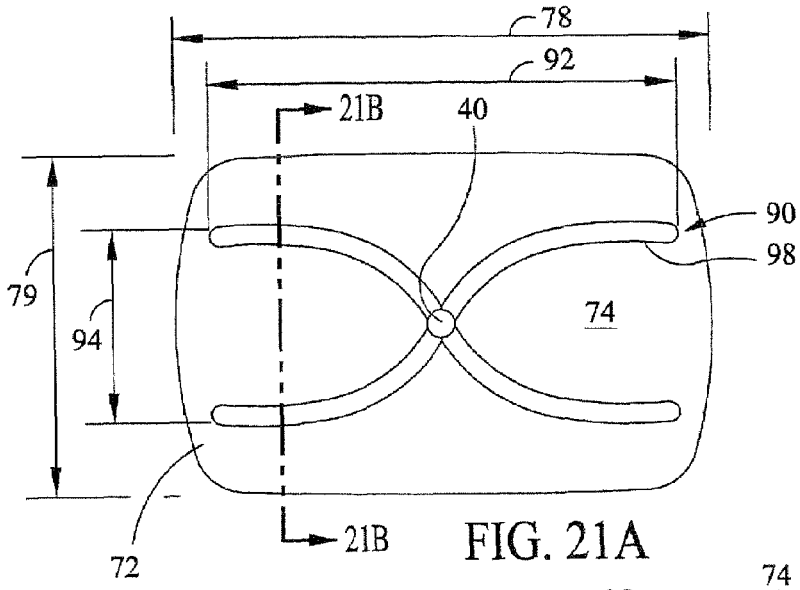
FIG. 21A shows a cross-sectional view of an embodiment of a fluid distribution system of the present invention.

FIG. 21A shows an embodiment of a surface distribution channel fluid distribution subsystem having a surface distribution channel 90 along the top surface 74 of the actuator top 72. Fluid enters the surface distribution channel 90 from the tube 40 when the actuator 74 is depressed. The surface distribution channel 90 may span a portion of the actuator top surface 74. For example, the maximum length 92 of the surface distribution channel 90 across the top surface 74 may be from about 60 to about 95% of the length 78 of the top surface 74. Similarly, the maximum width 94 of the surface distribution channel 90 across the top surface 74 may be from about 60 to about 95% of the width 79 of the top surface 74. Foam 98 may be fitted into the surface distribution channel 90. The foam 98 may be any conventional foam capable of absorbing a fluid and releasing that fluid to a substrate, such as a paper towel, sponge or the like when the foam 98 is compressed with the substrate.

Figure 21B:
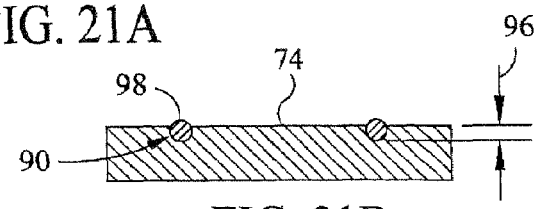
FIG. 21B shows a cross-sectional view along line 21B-21B of FIG. 21A.

FIG. 21B shows a cross-sectional view along line 21B-21B of FIG. 21A. The surface distribution channel 90 may have a depth 96 from about 1 mm to about 20 mm. The actual depth 96 may be chosen depending on the application. A deeper depth 96 may allow more fluid to be dispensed in a single actuation of the pump and may be useful in those applications where a larger volume of fluid is needed. The foam 98 may be of any shape to fit the contours of the surface distribution channel 90. As shown in FIG. 21B, the foam 98 may have a circular cross-section with at least a portion of the foam 98, typically about 50% of the foam 98, extending above the top surface 74 of the actuator top 72. While FIGS. 21A and 21B have an X-shaped surface distribution channel 90, other configurations of the surface distribution channel 90 may be used so long as the surface distribution channel 90 passes over tube 40 and covers an area of the top surface 74 larger than the circumferential area of the tube 40 alone.

Figure 22A:
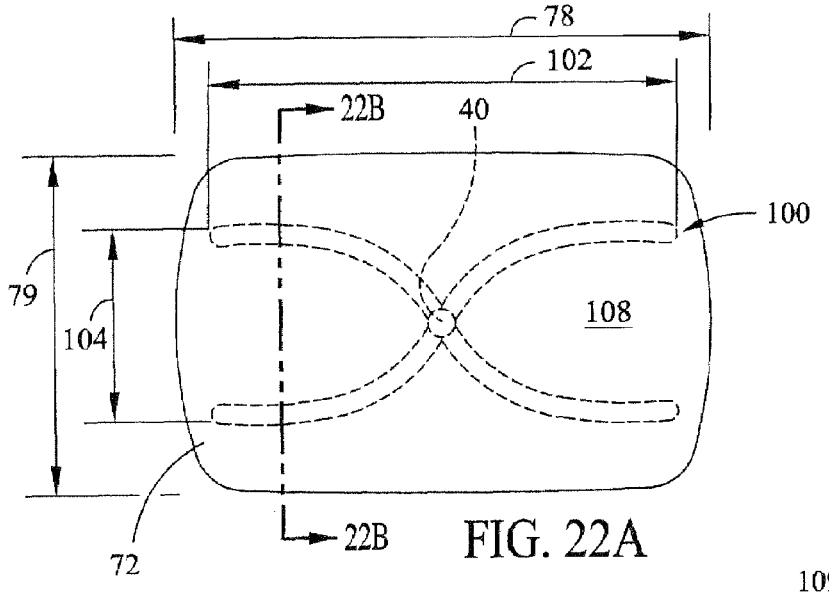
FIG. 22A shows a cross-sectional view of an embodiment of a fluid distribution system of the present invention.

FIG. 22A shows an embodiment of a fluid distribution subsystem having a surface distribution channel 100 along a top surface 74 of an actuator top 72. Fluid enters the surface distribution channel 100 from the tube 40 when the actuator 24 (not shown) is depressed. The surface distribution channel 100 may span a portion of the actuator top surface 74. For example, the maximum length 102 of the surface distribution channel 100 across the top surface 74 may be from about 60 to about 95% of the length 78 of the top surface 74. Similarly, the maximum width 104 of the surface distribution channel 100 across the top surface 74 may be from about 60 to about 95% of the width 79 of the top surface 74. A foam covering 108 may cover the top surface 74 such that fluid disbursed into the surface distribution channels 100 may be absorbed by the foam covering 108. When a paper towel, sponge or the like is pressed down on the foam covering 108, the fluid may be released from the foam covering 108 into the paper towel, sponge or the like.

Figure 22B:
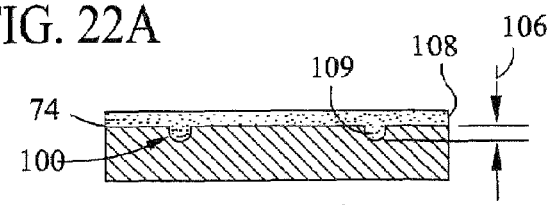
FIG. 22B shows a cross-sectional view along line 22B-22B of FIG. 22A.

FIG. 22B shows a cross-sectional view along line 22B-22B of FIG. 22A. The surface distribution channel 100 may have a depth 106 from about 1 mm to about 20 mm. The actual depth 106 may be chosen depending on the application. A deeper depth 106 may allow more fluid to be dispensed in a single actuation of the pump and may be useful in those applications where a larger volume of fluid is needed. The foam covering 108 may be of any shape and size to fit on the top surface 74 while covering the surface distribution channel 100. The foam covering 108 may have foam protrusions 109 attached to or formed integrally with the foam covering 108. The foam protrusions 109 are shaped the same as the shape of the surface distribution channel 100 thereby allowing the foam protrusions 109 to fit into the surface distribution channel 100 when the foam covering 108 is placed on the top surface 74. While FIGS. 22A and 22B have an X-shaped surface distribution channel 100, other configurations of the surface distribution channel 100 may be used so long as the surface distribution channel 100 passes over tube 40 and covers an area of the top surface 74 larger than the circumferential area of the tube 40 alone.

Figure 23A:
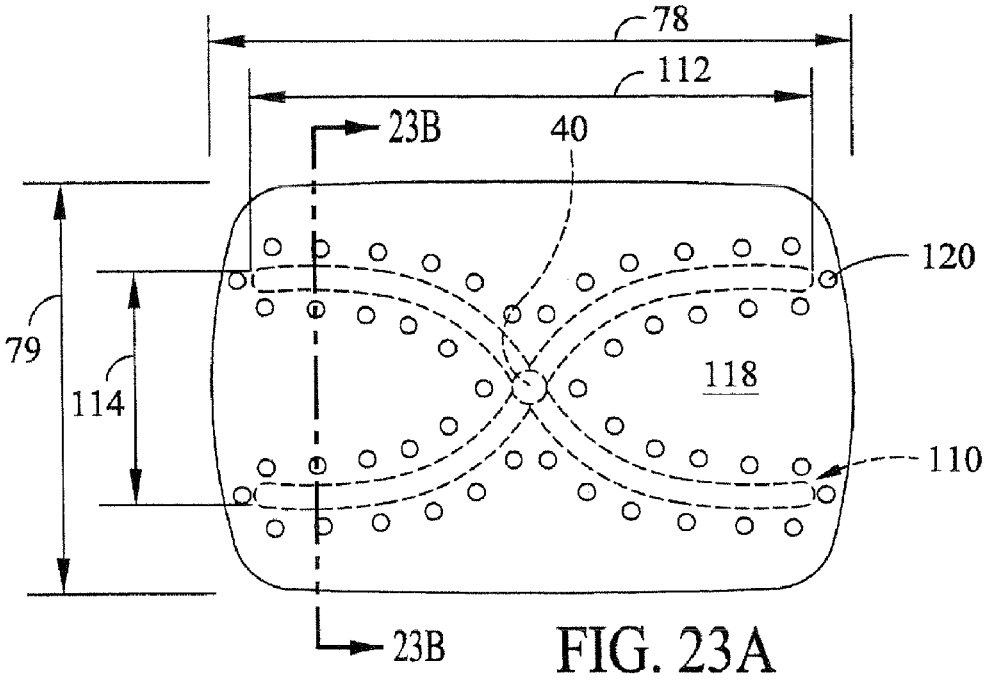
FIG. 23A shows a cross-sectional view of an embodiment of a fluid distribution system of the present invention.

FIG. 23A shows an embodiment of a fluid distribution subsystem having a surface distribution channel 110 along a top surface 74 of an actuator top 72. Fluid enters a surface distribution channel 110 from the tube 40 when the actuator 24 (not shown) is depressed. The surface distribution channel 110 may span a portion of the actuator top surface 74. For example, the maximum length 112 of the surface distribution channel 110 across the top surface 74 may be from about 60 to about 95% of the length 78 of the top surface 74. Similarly, the maximum width 114 of the surface distribution channel 110 across the top surface 74 may be from about 60 to about 95% of the width 79 of the top surface 74. A flexible layer 118 may be attached to the top surface 74 of the actuator top 72. The flexible layer 118 may be made of, for example, silicone, thermal plastic elastomer, low density polyethylene, polyethylene terephthalate or the like. Holes 120 may be formed in the flexible layer 118 to allow fluid to pass from the surface distribution channel 110 to a top surface 122 of the flexible layer 118. Holes 120 are formed on either side of the surface distribution channel 110 or both sides as shown in FIG. 23A. With the holes 120 being not directly over the surface distribution channel 110, fluid in the surface distribution channel 110 may not normally reach the top surface 122 of the flexible layer 118. As further shown with reference to FIG. 23B and FIG. 23C below, when fluid in the surface distribution channel 110 becomes pressurized, the pressure flexes the flexible layer 118 off of the top surface 74 of the actuator top 72 to allow fluid to pass from the surface distribution channel 110 through the holes 120 and to the top surface 122 of the flexible layer 118. This design may prevent the backflow of fluid from the top surface 122 of the flexible layer 118 to the tube 40, thereby potentially contaminating the contents of the container (not shown). This design may also function as an outlet valve and eliminate the need for an outlet valve in the pump.

Figure 23B:
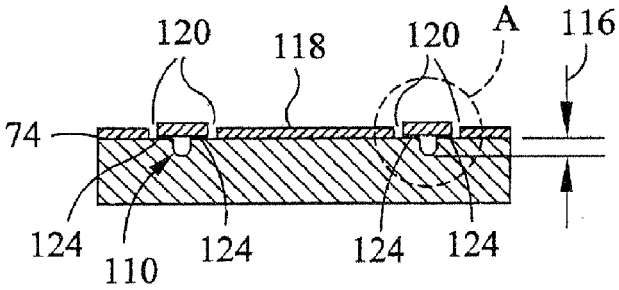
FIG. 23B shows a cross-sectional view along line 23B-23B of FIG. 23A.

FIG. 23B shows a cross-sectional view along line 23B-23B of FIG. 23A. The surface distribution channel 110 may have a depth 116 from about ½ mm to about 10 mm. The actual depth 116 may be chosen depending on the application. A deeper depth 116 may reduce the actuation force and may be useful in those applications where a larger volume of fluid is needed. When the fluid in the surface distribution channel 110 is pressurized, the flexible layer 118 may flex (e.g., separate from the top surface 74 of the actuator 72) at points 124 along either side of the surface distribution channel 110, thereby allowing fluid to pass into the holes 120. While FIGS. 23A and 23B have an X-shaped surface distribution channel 110, other configurations of the surface distribution channel 110 may be used so long as the surface distribution channel 110 passes over tube 40 and covers an area of the top surface 74 larger than the circumferential area of the tube 40 alone.

Figure 23C:
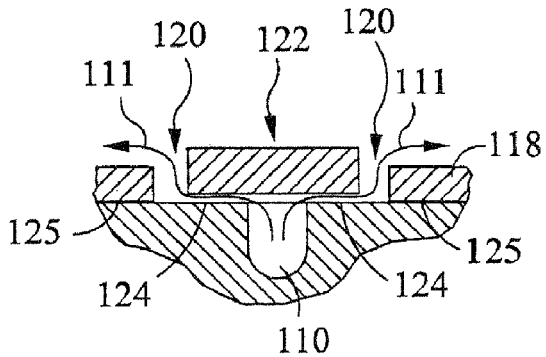
FIG. 23C shows a close up view of region A of FIG. 23B.

FIG. 23C shows a close up view of region A of FIG. 23B. When the fluid in the surface distribution channel 110 is pressurized, the flexible layer 118 may flex at points 124 as shown in FIG. 23C. This flexing of the flexible layer 118 allows fluid to flow along the path as shown by the arrow 111, from the surface distribution channel 110, through points 124, out through holes 120 and to the actuator top surface 74. Flexing of the flexible layer 118 may be prevented in areas 125 away from the holes 120 by affixing the flexible layer 118 to the actuator top surface 74. Alternatively, larger areas of flexible layer 118 can be unattached to the actuator top surface 74 and flex during actuation. The flexible layer 118 may be affixed to the actuator top surface 74 by any conventional means, such as with an adhesive, such as a glue or an epoxy.

Figure 24A:
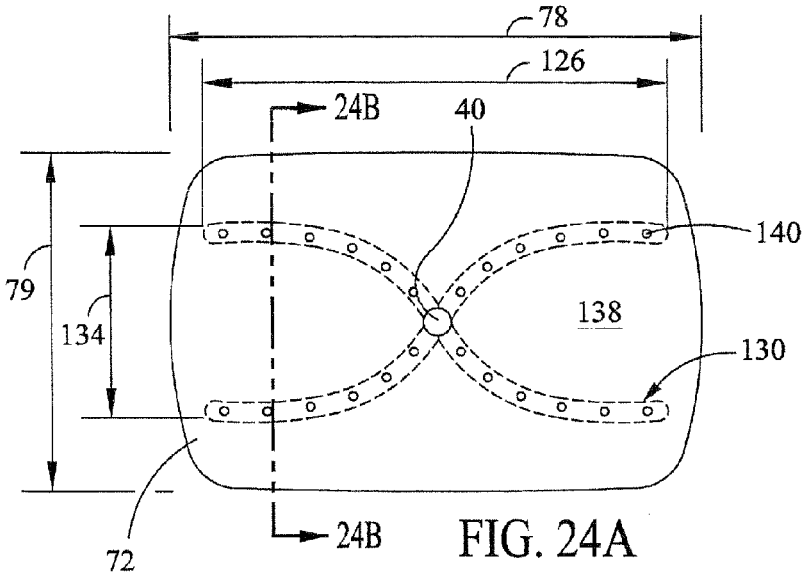
FIG. 24A shows a cross-sectional view of an embodiment of a fluid distribution system of the present invention.

FIG. 24A shows an embodiment of a fluid distribution subsystem having a surface distribution channel 130 along a top surface 74 of an actuator top 72. Fluid enters the surface distribution channel 130 from a tube 40 when the actuator 24 (not shown) is depressed. The surface distribution channel 130 may span a portion of the actuator top surface 74. For example, the maximum length 132 of the surface distribution channel 130 across the top surface 74 may be from about 60 to about 95% of the length 78 of the top surface 74. Similarly, the maximum width 134 of the surface distribution channel 130 across the top surface 74 may be from about 60 to about 95% of the width 79 of the top surface 74. A thin layer 138 may be attached to the top surface 74 of the actuator top 72. The thin layer 138 may be made of, for example, polyethylene, polypropylene, polyethylene terephthalate or the like. Holes 140 may be formed in the thin layer 138 to allow fluid to pass from the surface distribution channel 130 to a top surface 142 of the flexible layer 138. Holes 140 are formed directly above the surface distribution channel 110 as shown in FIG. 23A. When the fluid fills the surface distribution channel 110, fluid may then pass through the holes 140 to the top surface 142 of the flexible layer 138.

Figure 24B:
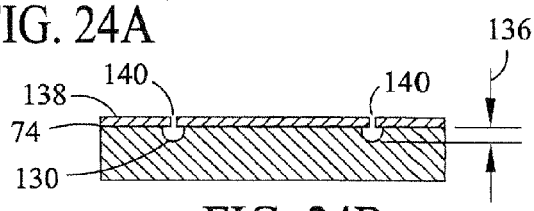
FIG. 24B shows a cross-sectional view along line 24B-24B of FIG. 24A.

FIG. 24B shows a cross-sectional view along line 24-24 of FIG. 24A. The surface distribution channel 130 may have a depth 136 from about ½ mm to about 20 mm. The actual depth 136 may be chosen depending on the application. A deeper depth 136 may allow more fluid to be dispensed in a single actuation of the pump and may be useful in those applications where a larger volume of fluid is needed. While FIGS. 24A and 24B have an X-shaped surface distribution channel 140, other configurations of the surface distribution channel 140 may be used so long as the surface distribution channel 140 passes over tube 40 and covers an area of the top surface 74 larger than the circumferential area of the tube 40 alone.

Figure 25A:
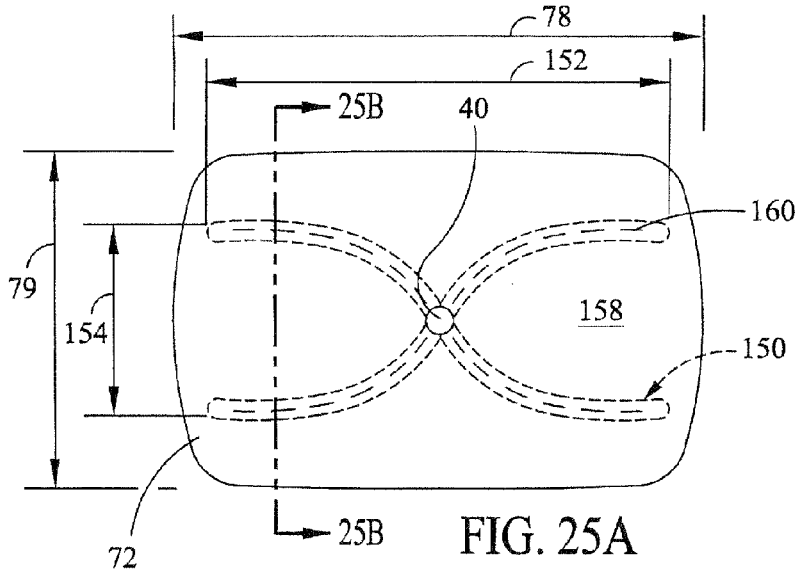
FIG. 25A shows a cross-sectional view of an embodiment of a fluid distribution system of the present invention.

FIG. 25A shows an embodiment of a fluid distribution subsystem having a surface distribution channel 150 along a top surface 74 of an actuator top 72. Fluid enters the surface distribution channel 150 from the tube 40 when the actuator 24 (not shown) is depressed. The surface distribution channel 150 may span a portion of the actuator top surface 74. For example, the maximum length 152 of the surface distribution channel 150 across the top surface 74 may be from about 60 to about 95% of the length 78 of the top surface 74. Similarly, the maximum width 154 of the surface distribution channel 150 across the top surface 74 may be from about 60 to about 95% of the width 79 of the top surface 74. A flexible layer 158 may be attached to the top surface 74 of the actuator top 72. The flexible layer 158 may be made of, for example, silicone, thermal plastic elastomer, low density polyethylene or the like. Slits 160 may be formed in the flexible layer 158 to allow fluid to pass from the surface distribution channel 150 to a top surface 162 of the flexible layer 158. Slits 160 are formed over the surface distribution channel 150 as shown in FIG. 25A. When the fluid in the surface distribution channel 150 becomes pressurized, the pressure flexes the flexible layer 158 to open the slits 160 to allow fluid to pass from the surface distribution channel 150 through the slits 160 and to the top surface 162 of the flexible layer 158. This design may prevent the backflow of fluid from the top surface 162 of the flexible layer 158 to the tube 40, thereby potentially contaminating the contents of the container (not shown). A simple linear slit may be used as shown, two or more crossing slits may open with less force and still close when the pressure is released.

Figure 25B:
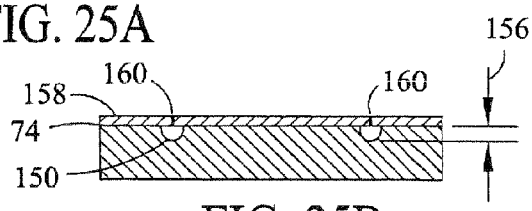
FIG. 25B shows a cross-sectional view along line 25B-25B of FIG. 25A.
Figure 26:
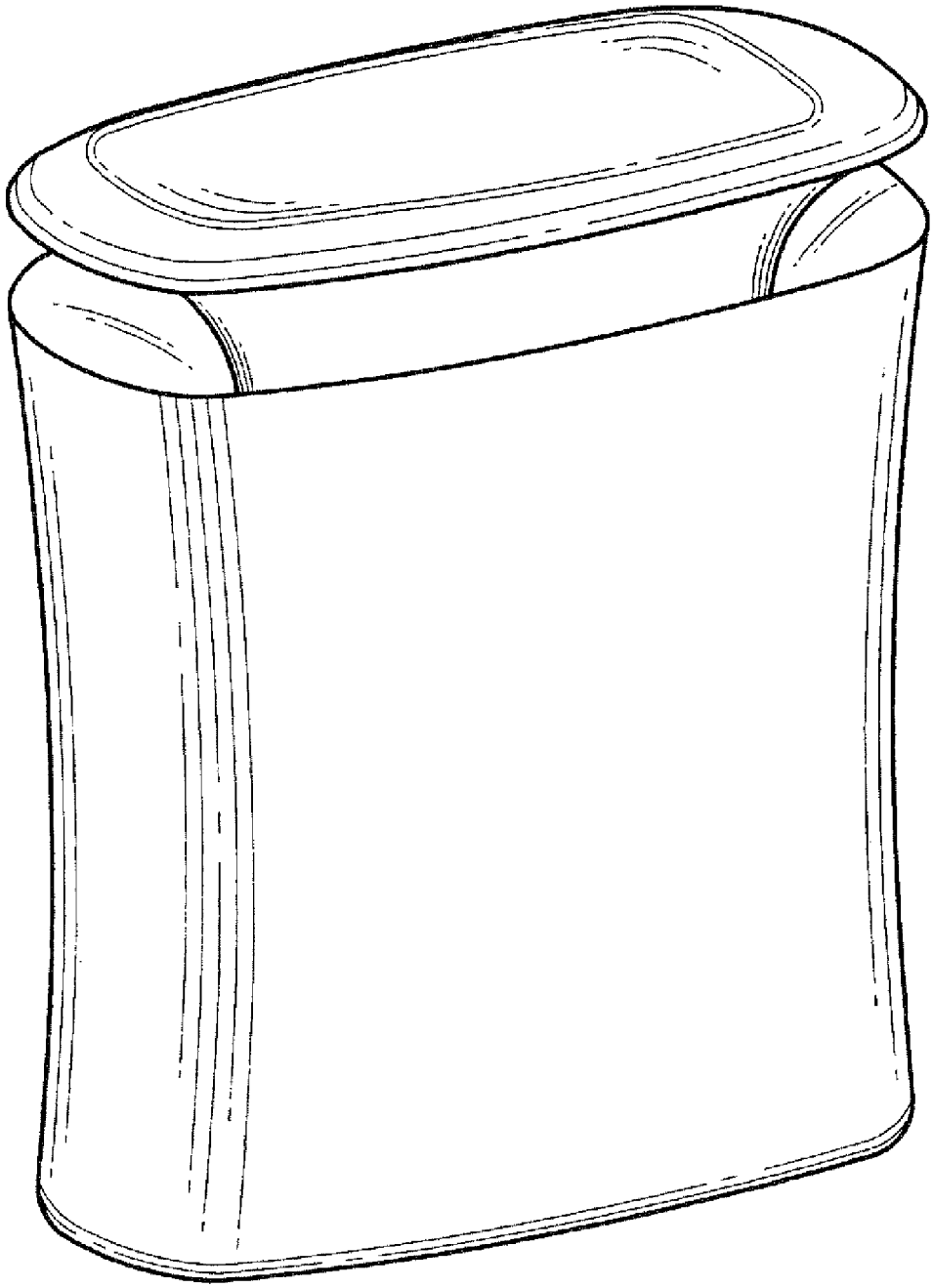
FIG. 26 shows a perspective view of an embodiment of the invention.
Figure 27:
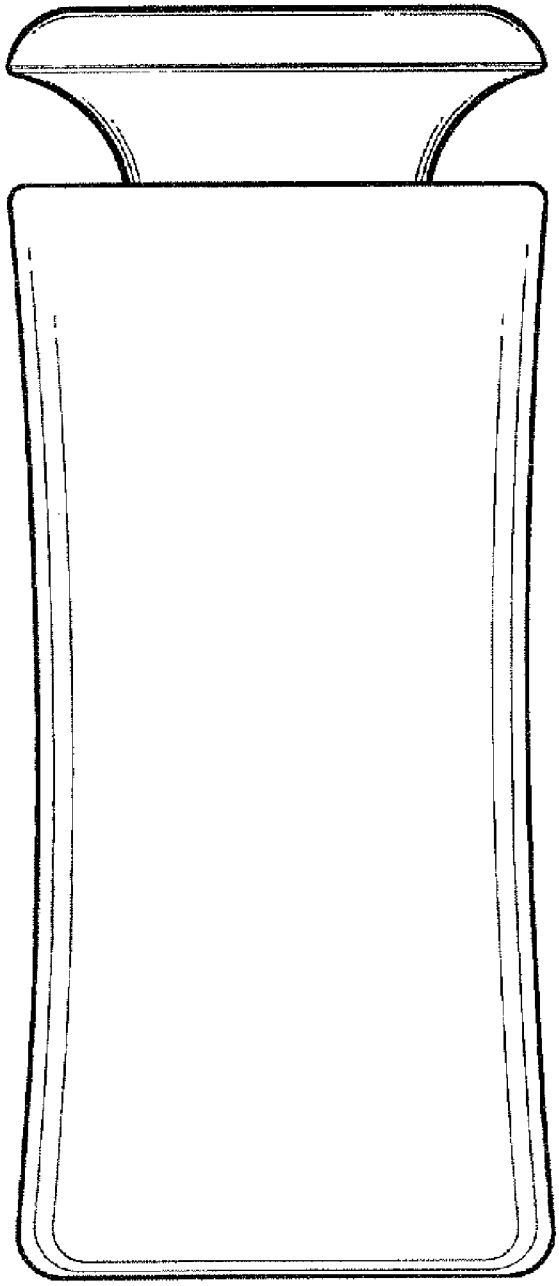
FIG. 27 shows a side view of an embodiment of the invention.
Figure 28:
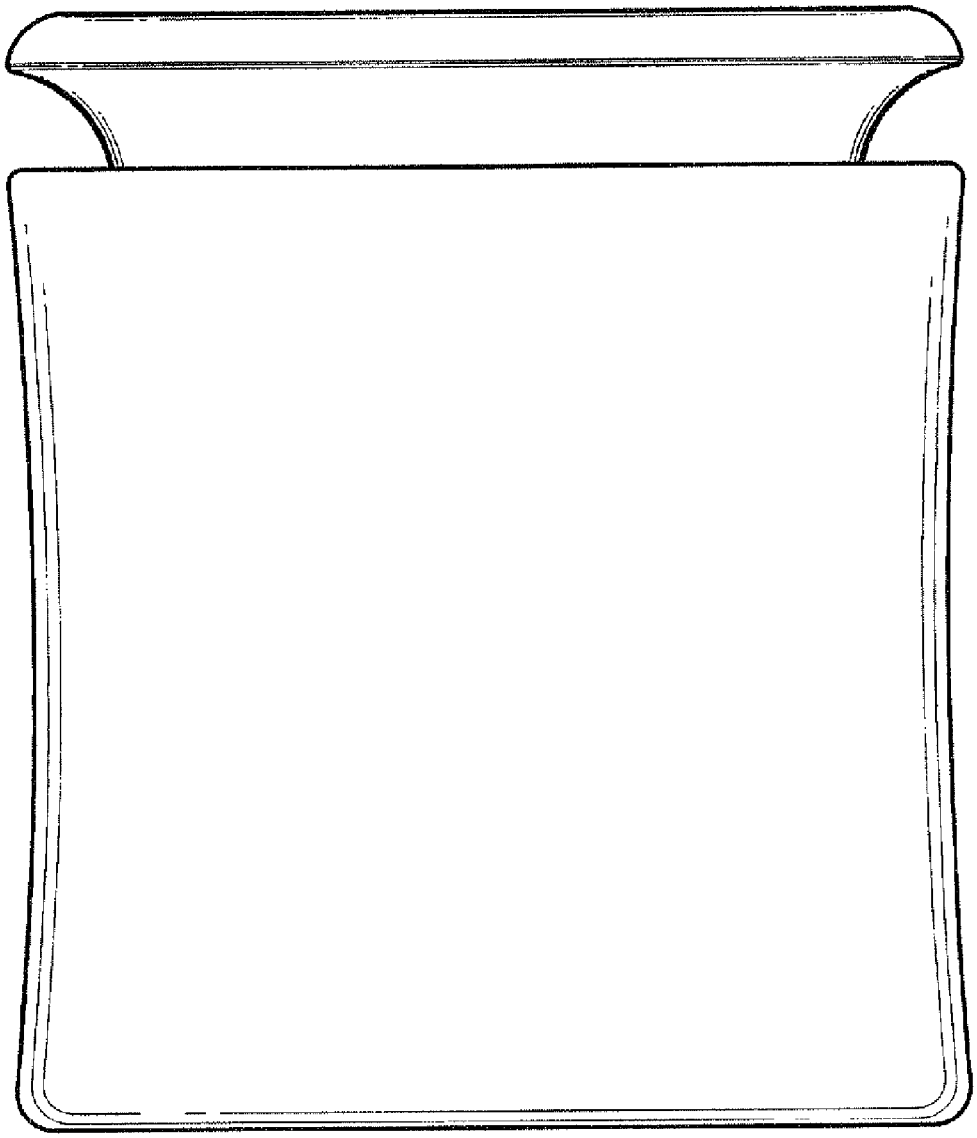
FIG. 28 shows a front view of an embodiment of the invention.
Figure 29:
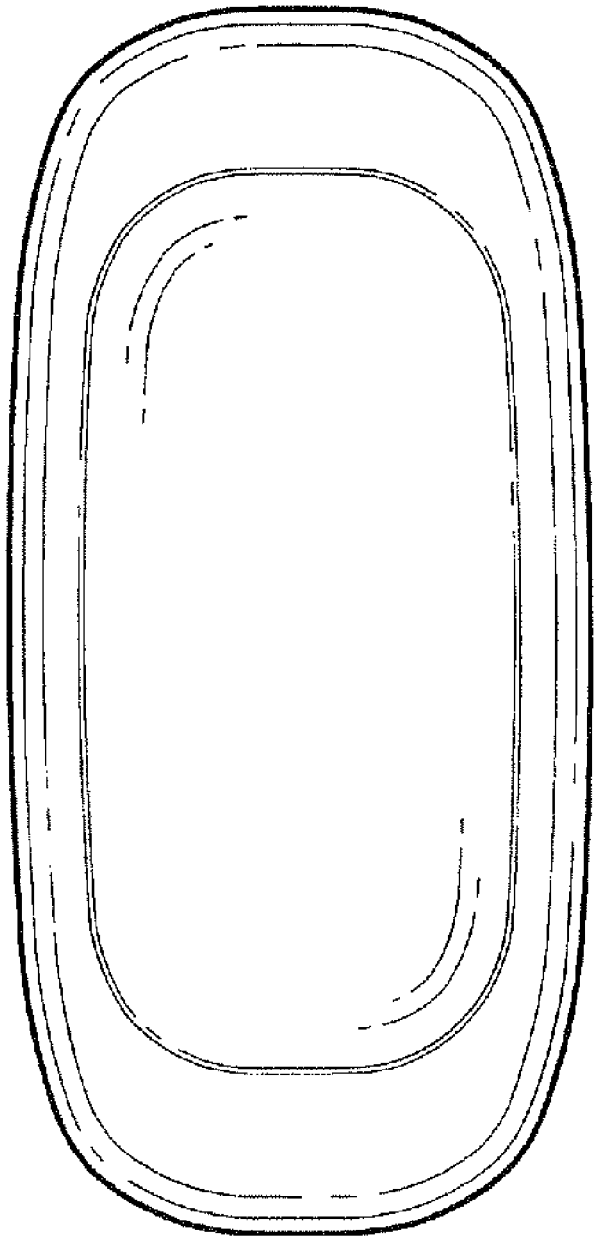
FIG. 29 shows a top view of an embodiment of the invention.
Figure 30:
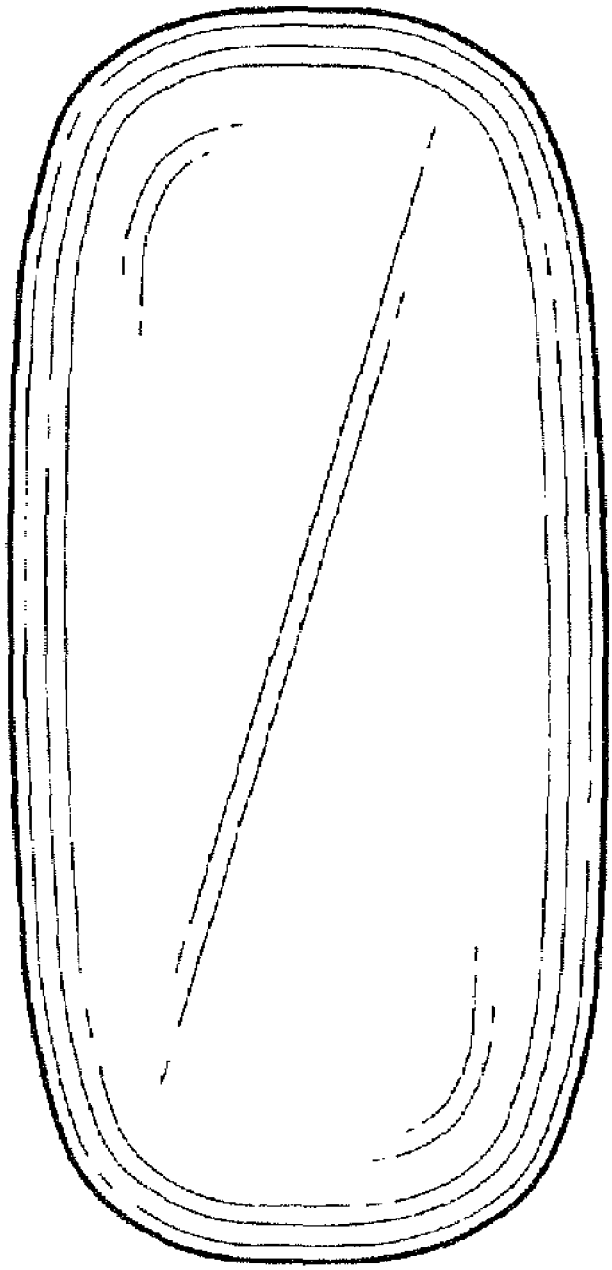
FIG. 30 shows a bottom view of an embodiment of the invention.

FIG. 25B shows a cross-sectional view along line 25-25 of FIG. 25A. The surface distribution channel 150 may have a depth 156 from about ½ mm to about 20 mm. The actual depth 156 may be chosen depending on the application. A deeper depth 156 may allow more fluid to be dispensed in a single actuation of the pump and may be useful in those applications where a larger volume of fluid is needed. While FIGS. 25A and 25B have an X-shaped surface distribution channel 150, other configuration of the surface distribution channel 150 may be used so long as the surface distribution channel 150 passes over tube 40 and covers an area of the top surface 74 larger than the circumferential area of the tube 40 alone.

As shown in FIGS. 23A, 23B, 25A and 25B, in one embodiment of the present invention the flexible layer 118 (158) is attached to the actuator top surface 74. The flexible layer 118 (158) has at least one of holes 120 and slits 160 therethrough to allow fluid to pass from the tube 40 to a top surface 122 (162) of the flexible layer 118 (158). The holes 120 and slits 160 may be designed, as described above, to prevent the backflow of fluid from the top surface 122 (162) of the flexible layer 118 (158) into the tube 40. Furthermore an area of the top surface 122 (162) of the flexible layer 118 (158) is greater than a circumferential area of the tube 40.

Additional Functional Features

In one embodiment, additional functional characteristics designed into the container base to offer stability and to encourage consumers to leave the product out on their counters so it is easily accessible. In one embodiment, a means is provided to allow the container to attach to the counter. One such example is a suction cup or other device on the bottom of the container. In addition to standing upright, for example on a counter-top, the dispenser package may be attached to a surface and used with the dispenser package orifices on the bottom, for example attached to the underside of kitchen cabinets.

In one embodiment, the exterior of the package dispenser is resistant to microorganisms. Various anti-microbial agents known in the art can be applied the exterior surface of the package dispenser to impart virucidal, bacterial, and/or germicidal properties thereto. The anti-microbial agent can comprise up to 100% of the surface area of the exterior surface of the dispenser, and in some embodiments, between about 10% to about 80%. The anti-microbial agent can include silver ions. In certain embodiments, a silver-zeolite complex can be utilized to provide controlled release of the anti-microbial agent. One commercially available example of such a time-release anti-microbial agent is sold as a fabric by HEALTH SHIELD® under the name GUARDTEX®, and is constructed from polyester and rayon and contains a silver-zeolite complex. Other suitable silver-containing microbial agents are disclosed in Japanese Unexamined Patent No. JP 10/259325. Moreover, in addition to silver-zeolites, other metal-containing inorganic additives can also be used in the present invention. Examples of such additives include, but are not limited to, copper, zinc, mercury, antimony, lead, bismuth, cadmium, chromium, thallium, or other various additives, such as disclosed in Japanese Patent No. JP 1257124 A and U.S. Pat. No. 5,011,602 to Totani, et al. In some embodiments, the activity of the additive can also be increased, such as described in U.S. Pat. No. 5,900,383 to Davis, et al.

Substrate

Potential substrates or tools that consumers could use with the package dispenser include woven or nonwoven dish cloths, sponges, paper towel, hands, facial tissue, bathroom tissue, paper, napkins, woven and nonwoven substrates, towels, wipes, and cotton balls. The package dispenser could also be used with clothes for stain removal purposes. Suitable substrates can comprise personal, cosmetic or sanitary wipes, baby wipes, hand wipes, wipes used in car cleaning, household or institutional cleaning or maintenance, computer cleaning and maintenance and any other area in which a flexible substrate having a useful liquid treatment composition has application. These substrates (tissues or wipes) can be made from simple nonwovens, complex nonwovens or treated, high-strength durable materials. The substrate can be two-sided or have a barrier so that only one side is wet with the composition upon use. Such substrates are described in U.S. Pat. App. 2005/0079987 to Cartwright et al.

Compositions

The composition can contain virtually any useful liquid compositions. Simple liquids such as water, alcohol, solvent, etc. can be useful in a variety of end uses, particularly cleaning and simple wiping applications. The liquid can be a simple cleaner, maintenance item or a personal care liquid suitable for dermatological contact with an adult, child or infant. Such compositions can be used in hospitals, schools, offices, kitchens, secretarial stations, etc. The compositions can also comprise more complex liquids in the forms of solutions, suspensions or emulsions of active materials in a liquid base. In this regard, such compositions can be active materials dissolved in an alcoholic base, aqueous solutions, water in oil emulsions, oil in water emulsions, etc. Such compositions can be cleaning materials, sanitizing materials, or personal care materials intended for contact with human skin, hair, nails, etc. Cleaning compositions used generally for routine cleaning operations not involving contact with human skin can often contain a variety of ingredients including, in aqueous or solvent base, a soil-removing surfactant, sequestrants, perfumes, etc. in relatively well-known formulations. Sanitizing compositions can contain aqueous or alcoholic solutions containing sanitizing materials such as triclosan, hexachlorophene, betadine, quaternary ammonium compounds, oxidizing agents, acidic agents, and other similar materials. Such compositions can be designed for treating or soothing human skin, including moisturizers, cleansing creams and lotions, cleansers for oily skin, deodorants, antiperspirants, baby-care products, sun block, sun screen, cosmetic-removing formula, insect repellent, etc. Moisturizer materials are preparations that reduce water loss or the appearance of water loss from skin. Cleansing creams or lotions can be developed that can permit the formulation to dissolve or lift away soil pigments, grime and dead skin cells. These creams or lotions can also be enhanced to improve removability of makeup and other skin soils. Cleaners for oily skin are often augmented with ethyl alcohol or isopropyl alcohol to increase the ability of the cleaner to remove excess oily residue. Deodorants and antiperspirants often contain, in an aqueous base, dispersions or emulsions comprising aluminum, zinc or zirconium compounds.

The composition may contain one or more additional surfactants selected from nonionic, anionic, cationic, ampholytic, amphoteric and zwitterionic surfactants and mixtures thereof. A typical listing of anionic, ampholytic, and zwitterionic classes, and species of these surfactants, is given in U.S. Pat. No. 3,929,678 to Laughlin and Heuring. A list of suitable cationic surfactants is given in U.S. Pat. No. 4,259,217 to Murphy. Where present, anionic, ampholytic, amphotenic and zwitteronic surfactants are generally used in combination with one or more nonionic surfactants. The surfactants may be present at a level of from about 0% to 90%, or from about 0.001% to 50%, or from about 0.01% to 25% by weight.

The compositions may contain suitable organic solvents including, but are not limited to, $C_{1-6}$ alkanols, $C_{1-6}$ diols, $C_{1-10}$ alkyl ethers of alkylene glycols, $C_{3-24}$ alkylene glycol ethers, polyalkylene glycols, short chain carboxylic acids, short chain esters, isoparafinic hydrocarbons, mineral spirits, alkylaromatics, terpenes, terpene derivatives, terpenoids, terpenoid derivatives, formaldehyde, and pyrrolidones. Alkanols include, but are not limited to, methanol, ethanol, n-propanol, isopropanol, butanol, pentanol, and hexanol, and isomers thereof. Diols include, but are not limited to, methylene, ethylene, propylene and butylene glycols. Alkylene glycol ethers include, but are not limited to, ethylene glycol monopropyl ether, ethylene glycol monobutyl ether, ethylene glycol monohexyl ether, diethylene glycol monopropyl ether, diethylene glycol monobutyl ether, diethylene glycol monohexyl ether, propylene glycol methyl ether, propylene glycol ethyl ether, propylene glycol n-propyl ether, propylene glycol monobutyl ether, propylene glycol t-butyl ether, di- or tripolypropylene glycol methyl or ethyl or propyl or butyl ether, acetate and propionate esters of glycol ethers. Short chain carboxylic acids include, but are not limited to, acetic acid, glycolic acid, lactic acid and propionic acid. Short chain esters include, but are not limited to, glycol acetate, and cyclic or linear volatile methylsiloxanes. Water insoluble solvents such as isoparafinic hydrocarbons, mineral spirits, alkylaromatics, terpenoids, terpenoid derivatives, terpenes, and terpenes derivatives can be mixed with a water-soluble solvent when employed. The solvents can be present at a level of from 0.001% to 10%, or from 0.01% to 10%, or from 1% to 4% by weight.

The compositions optionally contain one or more of the following adjuncts: stain and soil repellants, lubricants, odor control agents, perfumes, fragrances and fragrance release agents, and bleaching agents. Other adjuncts include, but are not limited to, acids, electrolytes, dyes and/or colorants, solubilizing materials, stabilizers, thickeners, defoamers, hydrotropes, cloud point modifiers, preservatives, and other polymers. The solubilizing materials, when used, include, but are not limited to, hydrotropes (e.g. water soluble salts of low molecular weight organic acids such as the sodium and/or potassium salts of toluene, cumene, and xylene sulfonic acid). The acids, when used, include, but are not limited to, organic hydroxy acids, citric acids, keto acid, and the like. Suitable organic acid can be selected from the group consisting of citric acid, lactic acid, malic acid, salicylic acid, acetic acid, adipic acid, fumaric acid, hydroxyacetic acid, dehydroacetic acid, glutaric acid, tartaric acid, fumaric acid, succinic acid, propionic acid, aconitic acid, sorbic acid, benzoic acid, gluconic acid, ascorbic acid, alanine, lysine, and mixtures thereof. Electrolytes, when used, include, calcium, sodium and potassium chloride. Thickeners, when used, include, but are not limited to, polyacrylic acid, xanthan gum, calcium carbonate, aluminum oxide, alginates, guar gum, methyl, ethyl, clays, and/or propyl hydroxycelluloses. Defoamers, when used, include, but are not limited to, silicones, aminosilicones, silicone blends, and/or silicone/hydrocarbon blends. Bleaching agents, when used, include, but are not limited to, peracids, hypohalite sources, hydrogen peroxide, and/or sources of hydrogen peroxide. When cleaning food contact surfaces, compositions for use herein may contain only materials that are food grade or GRAS, including, of course, direct food additives affirmed as GRAS, to protect against possible misuse by the consumer.

Preservatives, when used, include, but are not limited to, mildewstat or bacteriostat, methyl, ethyl and propyl parabens, short chain organic acids (e.g. acetic, lactic and/or glycolic acids), bisguanidine compounds (e.g. Dantagard® and/or Glydant®) and/or short chain alcohols (e.g. ethanol and/or IPA). The mildewstat or bacteriostat includes, but is not limited to, mildewstats (including non-isothiazolone compounds) include Kathon® GC, a 5-chloro-2-methyl-4-isothiazolin-3-one, Kathon® ICP, a 2-methyl-4-isothiazolin-3-one, and a blend thereof, and Kathon® 886, a 5-chloro-2-methyl-4-isothiazolin-3-one, all available from Rohm and Haas Company; BRONOPOL®, a 2-bromo-2-nitropropane 1,3 diol, from Boots Company Ltd., PROXEL® CRL, a propyl-p-hydroxybenzoate, from ICI PLC; NIPASOL® M, an o-phenyl-phenol, $Na^+$salt, from Nipa Laboratories Ltd., DOWICIDE® A, a 1,2-Benzoisothiazolin-3-one, from Dow Chemical Co., and IRGASAN® DP 200, a 2,4,4'-trichloro-2-hydroxydiphenylether, from Ciba-Geigy A.G.

The compositions can contain antimicrobial agents, including 2-hydroxycarboxylic acids and other ingredients, including quaternary ammonium compounds and phenolics. Non-limiting examples of these quaternary compounds include benzalkonium chlorides and/or substituted benzalkonium chlorides, di(C6-C14)alkyl di-short chain (C1-4 alkyl and/or hydroxyalkl) quaternaryammonium salts, N-(3-chloroallyl) hexaminium chlorides, benzethonium chloride, methylbenzethonium chloride, and cetylpyridinium chloride. Other quaternary compounds include the group consisting of dialkyldimethyl ammonium chlorides, alkyl dimethylbenzylammonium chlorides, dialkylmethyl-benzylammonium chlorides, and mixtures thereof. Biguanide antimicrobial actives including, but not limited to polyhexamethylene biguanide hydrochloride, p-chlorophenyl biguanide; 4-chlorobenzhydryl biguanide, halogenated hexidine such as, but not limited to, chlorhexidine (1,1'-hexamethylene-bis-5-(4-chlorophenyl biguanide) and its salts are also in this class. Another class of antibacterial agents, which are useful in the present invention, are the so-called "natural" antibacterial actives, referred to as natural essential oils. These actives derive their names from their natural occurrence in plants. Typical natural essential oil antibacterial actives include oils of anise, lemon, orange, rosemary, wintergreen, thyme, lavender, cloves, hops, tea tree, citronella, wheat, barley, lemongrass, cedar leaf, cedarwood, cinnamon, fleagrass, geranium, sandalwood, violet, cranberry, eucalyptus, vervain, peppermint, gum benzoin, basil, fennel, fir, balsam, menthol, ocmea origanum, Hydastis carradenisis, Berberidaceae daceae, Ratanhiae and Curcunta longa. Also included in this class of natural essential oils are the key chemical components of the plant oils which have been found to provide the antimicrobial benefit. These chemicals include, but are not limited to anethol, catechole, camphene, carvacol, eugenol, eucalyptol, ferulic acid, farnesol, hinokitiol, tropolone, limonene, menthol, methyl salicylate, thymol, terpineol, verbenone, berberine, ratanhiae extract, caryophellene oxide, citronellic acid, curcumin, nerolidol and geraniol. Other suitable antimicrobial actives include antibacterial metal salts. This class generally includes salts of metals in groups 3b-7b, 8 and 3a-5a. Specifically are the salts of aluminum, zirconium, zinc, silver, gold, copper, lanthanum, tin, mercury, bismuth, selenium, strontium, scandium, yttrium, cerium, praseodymiun, neodymium, promethum, samarium, europium, gadolinium, terbium, dysprosium, holmium, erbium, thulium, ytterbium, lutetium and mixtures thereof When the composition is an aqueous composition, water can be, along with the solvent, a predominant ingredient. The water should be present at a level of less than 99.9%, more preferably less than about 99%, and most preferably, less than about 98%. Deionized water is preferred. Where the cleaning composition is concentrated, the water may be present in the composition at a concentration of less than about 85 wt. %.

The dispenser can be used to transfer a wide variety of compositions to a substrate. These compositions include hard surface cleaners and sanitizers, personal care cleaners and other products, hand sanitizers, dish soap, laundry pre-treater, food products such as marinades, car products such as cleaners or protectants, and baby care products such as baby lotion. Also, suitable are compositions, such as hypochlorite especially dilute (below 500 ppm) hypochlorite, that lack good stability on nonwoven substrates. Other examples of compositions that may lack stability are quaternary ammonium disinfectants or metal ions that can bind to nonwoven substrates.

In one embodiment, the substrate can undergo a color change or other physical property change during the process of application using the dispenser or during the cleaning process. These changes can include color change due to the addition of a colorless cleaner/disinfectant, color change due to the addition of a composition containing a dye, color change when dye is thermochromic, and changes over time as solvent evaporates to cool the wipe, a color change due to reaction of solvent with a pre-bound species (e.g. transition metals) on the wipe, texture changes in the non-woven, and the impact of the using a dyed or patterned non-woven. The composition or substrate can incorporate solvatochromic dyes to indicate the presence of bacteria as described in U.S. Pat. App. 2005/0130253. In one embodiment, the composition contains a dye that interacts with proteins or bacterial on surfaces to indicate whether the surface is substantially free of soil (protein) or bacteria. In one embodiment, the soil or bacteria is detected on the substrate. In one embodiment, the soil or bacteria is detected on the surface. Colorimetric assays utilizing sampling devices for the detection of protein in biological samples are commonly used across various industries (biotech, healthcare, food, etc). These sampling devices require minimal manipulation of the protein-containing samples and allow for rapid qualitative and quantitative results. Among the various available colorimetric protein assays is one disclosed in U.S. Pat. No. 4,839,295 to Smith, incorporated herein in its entirety, that utilizes a Bicinchonic Acid (BCA) protein assay. This assay is based on the initial complexation of Copper [II], hereinafter $Cu^{++}$ or cupric ion, with protein peptides under alkaline conditions, with the reduction to Copper [I], hereinafter $Cu^+$ or the cuprous ion, in a concentration-dependent manner. The ligand BCA is then added in excess, and a purple color develops (562 nm peak absorbance) upon binding of BCA with $Cu^+$. Suitable detection devices are described in U.S. patent application Ser. No. 11/397,522 to Cumberland et al. filed Apr. 3, 2006 and U.S. patent application Ser. No. 11/427,469 to Cumberland et al. filed Jun. 29, 2006.

Methods of Use

Consumers enjoy the ease of use of the invention for reasons such as it utilizes cleaners differently, provides control such as no overspray, can be used one-handed, is compatible with wide variety of substrates, utilizes direct application so that no particles are aerosolized into the air, allows easy multi-tasking with other household activities, and is not limited by number of doses or wipes. Because of this flexibility, the consumer has more control to make the exact use conditions suitable to the task.

The dispensing package can be used as a one-handed method of cleaning a surface, where the consumer grabs a substrate in her hand, pushes the substrate down on the reciprocating actuator top of the dispensing package with her hand, allows the actuator top to move down and discharge a cleaning composition from the dispensing package to the substrate, and wipes the surface with the substrate. The substrate can be a paper towel, facial tissue, sheet of toilet tissue, a napkin, a sponge, a towel, the consumer's fingers or any other suitable woven or nonwoven substrate. Because the cleaning task takes only one hand, the other hand is free to perform another activity, such as holding a telephone, eating a snack and the task can be done quickly and easily without carrying the dispensing package to the area of the task.

Because the consumer is unfamiliar with the one-handed method of cleaning a surface, certain use indications on the dispensing package, any exterior packaging, or on advertising may be necessary to provide the consumer instant instruction on the use of the dispensing package, as shown in FIG. 9. In one embodiment, a hand is depicted over the dispensing package. In another embodiment, a hand holding a substrate is depicted over the dispensing package. In another embodiment, a hand holding a substrate (with an arrow pointing down) is depicted over the dispensing package, as shown in FIG. 9.

This method of cleaning of the invention has several advantages. If the consumer is preparing dinner and using one hand to contact raw food such as chicken that may contain microorganisms, then the consumer can use the other hand to do one-handed cleaning and disinfection of the food preparation surface, such as a countertop. Using a traditional cleaning product, such as a spray bottle and paper towel, the consumer picks up the spray bottle with the hand that has been potentially contaminated with microorganisms and transfers those microorganisms to the spray bottle. If the spray bottle or other product dispenser is contaminated with microorganisms, then the consumer can pick up and transfer microorganisms from the product dispenser. In the case of the one-handed method of the invention, the consumer contacts the product dispenser only at the actuator component which dispenses the disinfecting composition. In this case, there is less likelihood of transmission of microorganisms from dispenser to hands or from hands to dispenser.

Another advantage of the method and package of the present invention is control during delivery of the composition. With traditional spray dispensers, the consumer must attempt to fit the spray pattern of the spray bottle dispenser to the area to be cleaned. Frequently, the cleaning surface contains additional items, such as food or decorative items, which the consumer may not wish to contact with the cleaning composition. With the method and dispenser package of the invention, the consumer can controllably apply the composition to the substrate and then controllably apply the substrate containing the composition to the cleaning surface. If the consumer were to try spraying the substrate with a traditional spray dispenser, then some of the composition would be aerosolized into the air and some of the composition would miss the substrate and contact other surfaces such as the hand or food items.

Another area of concern for consumers is microorganism contaminated surfaces within the bathroom, especially around the toilet area. Consumers have ready access to toilet tissue but no ready mechanism to use it for spot cleaning. The method of the invention allows the consumer to use toilet tissue, which has limited wet strength and scrubbing strength, to spot clean surfaces around the toilet and other bathroom surfaces without using two hands and without having to pick up the dispensing package. With a suitable composition within the dispensing package, the consumer may also use the dispensing package and method of the invention for personal hygiene use.

With traditional dispensers such as trigger sprayers, the consumer has limited ability to control the pattern of dispensing the composition onto a surface or a substrate. In one case, the substrate, such as sponges, may be rectangular and the dispensing system may deliver a circular application of product. To effectively apply product to a substrate, such as a sponge, it may be desirable to apply the composition in a rectangular or oval fashion, where the applied product is dispersed more in one dimension than in the other dimension. Additionally, with the hand or a paper towel in a hand or a toilet tissue in a hand, it may also be desirable to apply the composition to the substrate in a non-circular fashion or where one dimension is greater than another. The method of the invention has the advantage that with a properly designed actuator component and orifices in the activator component, it may be possible to apply a non-circular pattern with one hand motion.

Some suitable substrates will not be stable long-term to all suitable compositions, for example toilet tissue or a sheet of facial tissue quickly loses its tensile strength when saturated with cleaning composition. Therefore, it is most suitable to wet the toilet tissue or facial tissue just before use. In some cases, the substrate loses at least 40%, or 50%, or 60%, or 70%, or 80%, or 90% peak dry tensile strength in machine or cross direction upon being loaded to full saturation with the composition. Peak dry tensile strength is the maximum load that a substrate can bear before breaking\rupturing under tension. With the method of the invention, these substrates may be useful for spot cleaning.

Other compositions are not stable on typical substrates, for example hypochlorite, especially dilute hypochlorite, is not storage stable on most nonwoven substrates as described in U.S. Pat. No. 7,008,600 to Katsigras et al. Additionally, compositions of very high or low pH are not generally storage stable on wipes or paper towels. Disinfectant compositions containing quaternary ammonium disinfectants or other cationic disinfectants bind to most nonwovens, especially cellulosic nonwovens, on storage so that they are not effectively released. The extent of binding can be measured by a quaternary recovery measurement on the wet substrate. The liquid squozate is acquired from the substrate by centrifugation after a seven day minimum requisite time of substrate-lotion equilibration. Substrates are put into a centrifuged tube for analysis, centrifuged at 3000 rpm for 15 min, and the liquid analyzed by HPLC. At equilibrium, the quaternary disinfectant show substantial binding to the substrate, for example, at least 10%, or 20%, or 30%, or 40%, or 50% by weight. However, the method of the invention, since it is quick and easy, lends itself to use of unstable substrates and unstable compositions, which may not be suitable under other methods of use.

The present invention relates to disinfecting compositions which can be used to disinfect various surfaces including inanimate surfaces such as hard surfaces like walls, tiles, floors, countertops, tables, glass, bathroom surfaces, and kitchen surfaces. The hard-surfaces to treat with the compositions herein are those typically found in houses like kitchens, bathrooms, e.g., tiles, walls, floors, chrome, glass, smooth vinyl, any plastic, plasticized wood, table top, sinks, cooker tops, dishes, sanitary fittings such as sinks, showers, shower curtains, wash basins, toilets and the like. Hard-surfaces also include household appliances including, but not limited to, refrigerators, freezers, washing machines, automatic dryers, ovens, microwave ovens, dishwashers and so on.

The dispenser package can be used around the house, for example, on kitchen or bathroom surfaces. The dispenser package can be used in public places, for example, in schools and school classrooms. For use around food, a food safe cleaner or disinfectant is suitable. The dispenser package allows the user to quickly apply a sanitizing or cleaning solution to everyday cleaning tools, such as sponges, paper towels, toilet paper, facial tissue, etc. When applied, the sanitizing or cleaning solution transforms the everyday cleaning tool into effective cleaning or sanitizing tools.

Additional Embodiments

In one embodiment, the package dispenser is a small palm-sized pouch of liquid cleaner that can be attached to any surface (e.g., side of a paper towel or facial tissue dispenser, under a cabinet, on a refrigerator, etc.) using dual-sided magnets or adhesive. A touch valve releases cleaner onto your paper towel, toilet paper, sponge, rag, etc. when pressure is applied. It then automatically stops dispensing when pressure is relieved to prevent dripping. The unit contains one cleaning packet with adhesive backing and/or two magnets so that the consumer can attach the cleaner packet to any surface using dual-sided magnets. The consumer peels off backing of adhesive strip from cleaning packet, and attaches the packet to the first magnet and positions the cleaning packet in the ideal location. If the surface is not metallic, the consumer can place the second magnet directly behind surface where cleaner is positioned to hold cleaning packet in place.

In one embodiment, the package dispenser is both a gel and mist cleaner. This dispenser is a dual dispensing cleaner that allows you to dispense one cleaner or two different cleaners in two different forms, a gel and a mist or spray. The package has a gel pump on top that works with a top actuator component as described previously and a liquid misting sprayer on the side. The unit contains one cleaning bottle and optionally a wall mounting base and attachments. To use this embodiment, press and pump your paper towel on the cleaning gel actuator component. To use the misting spray, squeeze the trigger on the side.

In one embodiment, the package dispenser is a discreet and mountable cleaner dispenser. This package is a mountable cleaning product package with a press and pump dispenser. The package is thin and discreet, about the size of a flattened tissue box. It can be mounted horizontally or vertically with adhesive to surface of your choice (e.g., under cabinets, side of counter, side of toilet tank, etc.). The unit contains one package dispenser with adhesive back. In another embodiment, the package dispenser is a hangable cleaner that can be hung anywhere (e.g., shower door/curtain rod, towel rack, kitchen cabinet, shower head, etc.) with the hook on top. The dispenser has a valve on the bottom of the bottle that releases the composition when the actuator component is pushed.

In one embodiment, the package dispenser is a mountable or counter standing dispenser that automatically dispenses the composition onto your paper towel, toilet paper, sponge, rag, etc. A sensor on the package dispenser works to activate the actuator component when you hold your paper towel, toilet paper, sponge, rag, etc. under or over the actuator component. The unit package can contain wall-mounting and counter-holding suction cups, dispensing machine, refillable cleaner cartridge and battery. In one embodiment, this package dispenser is plugged into an outlet to run the sensor and pump.

In one embodiment, the package dispenser can be stamped directly onto the cleaning or treatment surface. The consumer presses the entire bottle onto surface so that actuator depresses and product is applied directly to the surface. The consumer can then use whatever substrate she prefers to distribute composition around the surface. The package dispenser can be stored with the actuator component either facing up or down near the surface. If the actuator component faces down to the surface, it would be more ergonomic to apply because the consumer would not have to turn it upside down and twist their wrist. Where it is desirable to leave the composition on the surface for a desired treatment time, such as in fabric stain treatment or some personal care treatments, the composition can be applied directly with the package dispenser and then later treated with the substrate.

In one embodiment, the package dispenser is paper towel holder. The package dispenser can fit in the center of a paper towel or toilet paper role. The actuator component sticks out the top of the roll. The consumer can then easily remove a substrate from the roll and apply product to the substrate. In one embodiment, package dispenser is an aerosolized bottle that provides one-touch application of composition to the substrate. The consumer could press and hold substrate to actuator component until the desired amount of composition was on substrate.

In one embodiment, the product or package contains directions to store the substrate on top of the package, for example a sponge on top of dispensing package actuator. In one embodiment, the product or package includes the dispensing package and substrates sold together, for example paper towels with the dispensing package. In one embodiment, several dispensing packages are bundled in multi-packs, for example a dispensing package containing dish soap and a dispensing package containing a kitchen cleaner. In one example, the dispensing package is sold with one or more refills.

While this detailed description includes specific examples according to the invention, those skilled in the art will appreciate that there are many variations of these examples that would nevertheless fall within the general scope of the invention and for which protection is sought in the appended claims.

What is claimed is:

1. A retail display for a set of products comprising:

a. a first product comprising a container having an actuator with an actuator top surface and a fluid distribution system, wherein the fluid distribution system comprises a tube delivering fluid to the actuator top surface, and wherein depression of the actuator causes fluid to travel through the tube toward the actuator top surface, wherein a subsystem of the fluid distribution system delivers fluid to an area of the actuator top surface greater than the circumferential area of the tube, wherein the fluid is a treatment composition;

b. a second product comprising a sponge for applying the fluid of the first product; and c. packaging for the set of products;

d. wherein the actuator top surface is concave;

wherein the second product sits on top of the actuator top surface and is held in place by the packaging as part of the retail display.

2. The retail display of claim 1, wherein the actuator top surface and the substrate have substantially the same X-Y dimensions.

3. The retail display of claim 1, wherein the ratio of the X-Y area of the actuator top surface and the substrate is from 0.8:1 to 1:0.8.

4. The retail display of claim 1, wherein the second product does not have a handle.

5. The retail display of claim 1, wherein the packaging shows an illustration of the second product sitting on top of the first product and a depiction of a consumer hand above the second product.

6. The retail display of claim 1, wherein the subsystem is selected from the group consisting of a manifold type distribution subsystem, a spray type distribution subsystem, and a surface distribution channel type distribution subsystem.

7. A method of conveying the use of a novel dispenser comprising:

packaging together a top actuating fluid dispenser and a fluid application sponge together wherein the dispenser has an actuator with a concave actuator top surface and a fluid distribution system, wherein the fluid distribution system comprises a tube delivering fluid to the actuator top surface, and wherein depression of the actuator causes fluid to travel through the tube toward the actuator top surface, wherein a subsystem of the fluid distribution system delivers fluid to an area of the actuator top surface greater than the circumferential area of the tube, wherein the fluid is a treatment composition; wherein the sponge sits on top of the actuator top surface and is held in place by packaging as part of a retail display.

* * * * *